US011279574B2

(12) United States Patent
Hamlin et al.

(10) Patent No.: US 11,279,574 B2
(45) Date of Patent: Mar. 22, 2022

(54) MAILER DISPENSERS

(71) Applicant: Sealed Air Corporation (US), Charlotte, NC (US)

(72) Inventors: Christopher C. Hamlin, Worcester, MA (US); Thomas P. Orsini, Sterling, MA (US); Patrick G. White, Westford, MA (US); Russell T. Christman, Dunstable, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/046,999

(22) PCT Filed: Apr. 12, 2019

(86) PCT No.: PCT/US2019/027172

§ 371 (c)(1),
(2) Date: Oct. 12, 2020

(87) PCT Pub. No.: WO2019/200226

PCT Pub. Date: Oct. 17, 2019

(65) Prior Publication Data

US 2021/0047138 A1 Feb. 18, 2021

Related U.S. Application Data

(60) Provisional application No. 62/657,219, filed on Apr. 13, 2018.

(51) Int. Cl.
*B65H 1/06* (2006.01)
*B65H 3/24* (2006.01)

(52) U.S. Cl.
CPC ..... *B65H 1/06* (2013.01); *B65H 3/24* (2013.01); *B65H 2407/21* (2013.01); *B65H 2701/1916* (2013.01)

(58) Field of Classification Search
CPC ... B65H 2701/1916; B43M 3/00; B43M 3/04; B43M 3/045; B43M 5/30; B43M 5/36; B43M 7/00; B43M 7/004
See application file for complete search history.

(56) References Cited

U.S. PATENT DOCUMENTS 1,720,505 A 7/1929 Williamson
3,884,010 A 5/1975 Bardo et al.
(Continued)

FOREIGN PATENT DOCUMENTS

WO 9930601 A1 6/1999
WO 2011032565 A2 3/2011
(Continued)

OTHER PUBLICATIONS

Written Opinion of the International searching authority in PCT/US2019/027172 dated Oct. 17, 2019.

*Primary Examiner* — Howard J Sanders
(74) *Attorney, Agent, or Firm* — Jon M. Isaacson

(57) ABSTRACT

A dispenser (200) includes a supply structure (202) and a biasing structure (206). The supply structure holds mailers (204). A mailer from the mailers includes a first wall and a second wall. The first and second walls are closed at a first side of the mailer, closed at a second side of the mailer, and closed at a closed end of the mailer. The first and second walls are not closed at an open end of the mailer. The mailer is arranged to be dispensed from the supply structure (202). The biasing structure (206) is arranged to engage the mailer as the mailer is dispensed from the supply structure (202). The biasing structure (206) has narrowing surfaces configured to contact the sides of the mailer as the mailer is dispensed. The narrowing surfaces of the biasing structure (206) are arranged to narrow the open end of the mailer thereby causing the open end to be biased open.

3 Claims, 16 Drawing Sheets

(56) References Cited

U.S. PATENT DOCUMENTS

| | | | | |
|---|---|---|---|---|
| 3,917,113 | A | 11/1975 | Light | |
| 5,255,498 | A * | 10/1993 | Hotchkiss | B43M 3/045 53/258 |
| 5,992,132 | A * | 11/1999 | Auerbach | B43M 3/045 493/259 |
| 6,098,374 | A | 8/2000 | Yates et al. | |
| 6,241,118 | B1 * | 6/2001 | Tramontina | A47K 10/424 221/45 |
| 6,598,759 | B2 * | 7/2003 | Carriere | B65H 1/06 221/45 |
| 6,698,748 | B1 | 3/2004 | Crowley | |
| 2002/0100763 | A1 | 8/2002 | Carriere | |
| 2004/0080099 | A1 * | 4/2004 | Janatka | B65H 9/04 271/245 |

FOREIGN PATENT DOCUMENTS

| | | | |
|---|---|---|---|
| WO | 2014133355 | A1 | 9/2014 |
| WO | 2019200220 | A1 | 10/2019 |

* cited by examiner

MAILER DISPENSERS

BACKGROUND

The present disclosure is in the technical field of mailer dispensers. More particularly, the present disclosure is directed to mailer dispensers that bias open the open ends of mailers as the mailers are dispensed from the dispensers.

A wide variety of objects, including fragile items, are transported in various types of mailing envelopes, sometimes referred to as "mailers." In some cases, mailers have an outer wall to protect the contents of the mailers. The outer walls of cushioned mailers are typically formed from protective materials, such as Kraft paper, cardstock, polyethylene-coated paper, other paper-based materials, polyethylene film, or other resilient materials. In some examples, the outer wall provides structural rigidity (e.g., the outer wall is made from cardstock).

In other cases, these mailers have cushioning in addition to the outer wall to provide some level of protection for the objects transported therein. With cushioned mailers, the outer walls of cushioned mailers are typically formed from protective materials, such as Kraft paper, cardstock, polyethylene-coated paper, other paper-based materials, polyethylene film, or other resilient materials. The inner walls of cushioned mailers are lined with cushioning materials, such as air cellular material (e.g., BUBBLE WRAP™ air cellular material sold by Sealed Air Corporation), foam sheets, or any other cushioning material. The outer walls are typically adhered (e.g., laminated) to the cushioning material when forming the mailers.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a dispenser includes a supply structure and a biasing structure. The supply structure is configured to hold a plurality of mailers. A mailer of the plurality of mailers includes a first wall and a second wall. The first and second walls are closed at a first side of the mailer, closed at a second side of the mailer, and closed at a closed end of the mailer. The first and second walls are not closed at an open end of the mailer. The mailer is arranged to be dispensed from the supply structure. The biasing structure is arranged to engage the mailer as the mailer is dispensed from the supply structure. The biasing structure has narrowing surfaces configured to contact the sides of the mailer as the mailer is dispensed. The narrowing surfaces of the biasing structure are arranged to narrow the open end of the mailer thereby causing the open end to be biased open.

In one example, the dispenser is arranged to dispense the mailer from the supply structure in a direction that is substantially parallel to the open end of the mailer. In another example, the narrowing surfaces include two planar surfaces arranged with respect to the supply structure so that the sides of the mailer contact the two planar surfaces as the mailer is dispensed from the supply structure. In another example, the two planar surfaces converge as the two planar surfaces extend in the direction that the mailer is dispensed from the supply structure. In another example, the dispenser further includes a dispensing mechanism configured to be selectively coupled to one of the plurality of mailers and to dispense the one of the plurality of mailers out of the supply structure and to bring sides of the one of the plurality of mailers into contact with the two planar surfaces. In another example, the dispensing mechanism is driven by rotary motion of a driving wheel. In another example, the narrowing surfaces are linear ratcheting surfaces configured to resist motion of the mailer toward the supply structure at points in the direction that the mailer is dispensed from the supply structure. In another example, at one of the point where the linear ratcheting surfaces resist motion of the mailer toward the supply structure, the linear ratcheting surfaces are arranged to cause the open end of the mailer to be biased open.

In another example, mailers in each pair of subsequent mailers in the supply structure are adhered to each other. In another example, each pair of subsequent mailers in the supply structure are adhered to each other by a dot adhesive. In another example, the dot adhesive between the each pair of subsequent mailers in the supply structure is located substantially equidistantly from the first and second sides of the subsequent mailers and located at a distance from the open ends of the subsequent mailers in a range between about 2 inches and about 6 inches. In another example, the supply structure includes one or more flanges arranged such that, as a first mailer is dispensed from the supply structure, a subsequent mailer contacts the one or more flanges so that shear stress is imparted to adhesive between the first mailer and the subsequent mailer until the adhesive is no longer adhered to at least one of the first mailer or the subsequent mailer. In another example, the supply structure includes a post configured to cause rotation of the first mailer as the first mailer is dispensed from the supply structure. In another example, the flanges include flared portions that extend outward from the open ends of the plurality of mailers in the supply structure.

In another example, the dispenser is arranged to dispense the mailer from the supply structure in a direction that is substantially perpendicular to the open end of the mailer. In another example, the narrowing surfaces are arranged with respect to the supply structure so that the sides of the mailer contact the narrowing surfaces as the mailer is dispensed from the supply structure in the direction that is substantially perpendicular to the open end of the mailer. In another example, the dispenser further includes a pushing mechanism configured to push the mailer from the supply structure in the direction that is substantially perpendicular to the open end of the mailer until the open end of the mailer at least reaches an opening between the narrowing surfaces. In another example, the pushing mechanism includes a tray located in a slot in a bottom of the supply structure. In another example, the pushing mechanism includes at least one tab extending through at least one slot in a bottom of the supply structure.

In another example, the dispenser further includes a guide positioned so that the mailer passes between a portion of the supply structure and the guide as the mailer is dispensed from the supply structure in the direction that is substantially perpendicular to the open end of the mailer. In another example, the portion of the supply structure is a bottom of the supply structure and the guide is configured so that the mailer passes beneath the guide as the mailer is dispensed from the supply structure in the direction that is substantially perpendicular to the open end of the mailer. In another example, the supply structure includes a container configured to hold the plurality of mailers. In another example, the container includes a first set of flaps, and the first set of flaps are the narrowing surfaces of the biasing structure. In another example, the container includes a second set of flaps, and the first and second sets of flaps are configured to interconnect so that the first set of flaps is held in an arrangement to contact the sides of the mailer as the mailer is dispensed.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of mailer dispensers that bias the openings of mailers open as the mailers are dispensed from the dispensers.

More particularly, the present disclosure describes embodiments of mailer dispensers that have supply structures to hold mailers and a biasing structure to cause an open end of a mailer to be biased open as the mailer is dispensed from the supply structure. The biasing structure is arranged to engage the mailer as the mailer is dispensed from the supply structure. The biasing structure has narrowing surfaces configured to contact the sides of the mailer as the mailer is dispensed. The narrowing surfaces of the biasing structure are arranged to narrow the open end of the mailer thereby causing the open end to be biased open.

Mailers are convenient because they require minimal training for a user to be able to place an object inside the mailer and adhere a flap closed over the opening. However, there are a number of drawback to cushioned mailers. In one example, of the total time it takes a user to package a cushioned mailer, a significant portion of the time can be taken up by obtaining the mailer and bringing the mailer into a position where an object can be inserted into the mailer. In another example, of the total time it takes a user to package a cushioned mailer, a significant portion of the time can be taken up by opening the open end of the mailer and holding the open end of the mailer open as the object is inserted. The amount of time taken for these tasks may only be a few seconds to package each mailer; however, this time taken for each mailer can accumulate over multiple mailers and become a significant problem, particularly in high-volume packaging facilities. It would be advantageous to reduce the amount of time require to dispense and open mailers.

Figure 1:
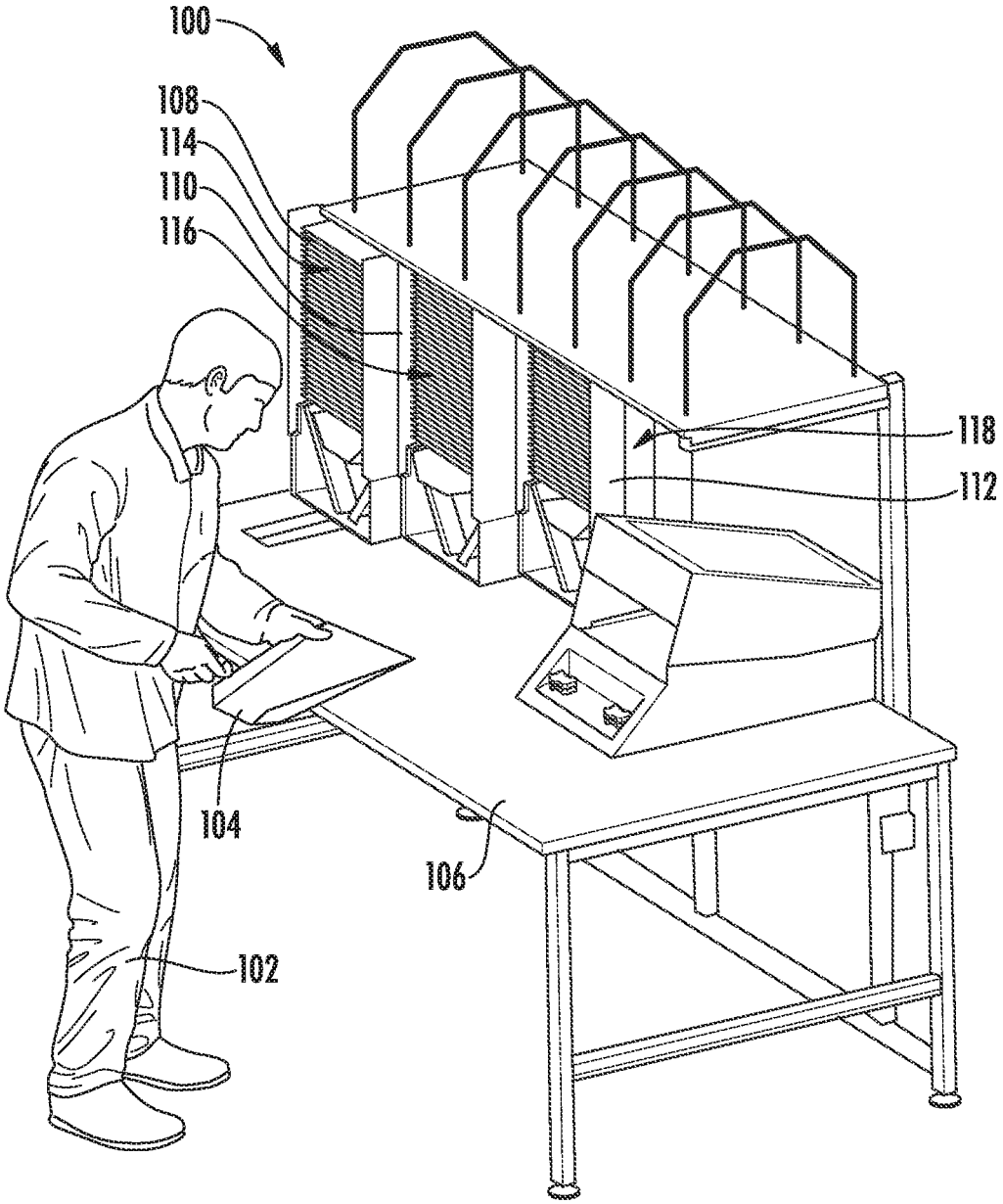
FIG. 1 depicts a packaging station at which a user can fill and close a mailer, in accordance with the embodiments disclosed herein.

Depicted in FIG. 1 is a packaging station 100 at which a user 102 can fill and close a mailer 104. The packaging station 100 includes a working surface 106. In the depicted embodiment, the user 102 selected the mailer 104 from one of a number of dispensers 108, 110, and 112 of mailers. In the depicted embodiment, the dispensers 108, 110, and 112 respectively hold mailers 114, 116, and 118. Each of the sets of mailers 114, 116, and 118 has a different size (e.g., a different width and/or a different length) than the other sets. In some cases, the user 102 may have selected the mailer 104 from one of the dispensers 108, 110, and 112 based on a size of an object to be inserted into the mailer 104.

In various embody embodiments, the mailer 104 may be a cushioned mailed (e.g., a mailer having Kraft paper outer walls with an air cellular material lining inside the outer walls) or a mailer that has outer walls made from protective materials but does not include any cushioning material. In some embodiments, a mailer is made from two walls that form a front and a back of the mailer. The mailer is closed on two sides and at a closed end and the mailer is open and an open end. In some embodiments, the mailer is formed by folding a protective material so that protective material on either side of the fold form the two walls and the fold forms the closed end. The sides of the protective material are sealed or adhered together to form closed sides of the mailer. The end of the mailer opposite the closed end can be left open to form an open end of the mailer. The user can close the open end after inserting an object in to the mailer. In other embodiments, the mailer is formed from two pieces of protective material that are sealed or adhered together to form the closed end and the two sides of the mailer.

In the depicted embodiment, the dispensers 108, 110, and 112 are located on the working surface 106 to provide convenience for the user 102 to dispense one of the mailers 114, 116, and 118. The location of the dispensers 108, 110, and 112 may increase the speed with which the user 102 is able to dispense and fill mailers. However, even if the dispensers 108, 110, and 112 are located in a convenient position to dispense mailers quickly, it will still take time for the user 102 to open the mailers and hold the mailers open while inserting objects into the mailers. Described below are embodiments of dispensers that cause the open ends of mailers to be biased open as the mailers are dispensed. In some embodiments, the dispensers hold the open ends in the biased-open position wile objects are inserted into the mailers. The dispensers disclosed herein may be used in place of one or all of the dispensers 108, 110, and 112 to reduce the amount of time and effort the user 102 needs to spend to dispense and fill mailers.

Figure 2B:
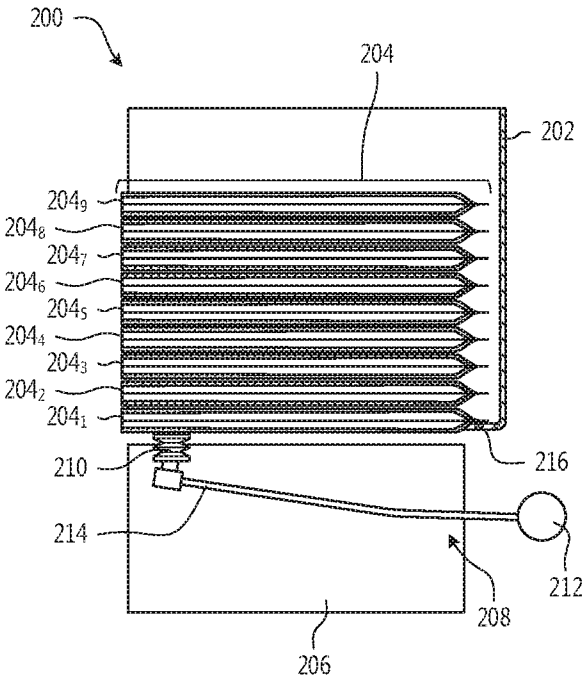
FIGS. 2A and 2B depict front and cross-sectional side views, respectively, of one instance of an embodiment of a dispenser, in accordance with the embodiments disclosed herein.
Figure 2A:
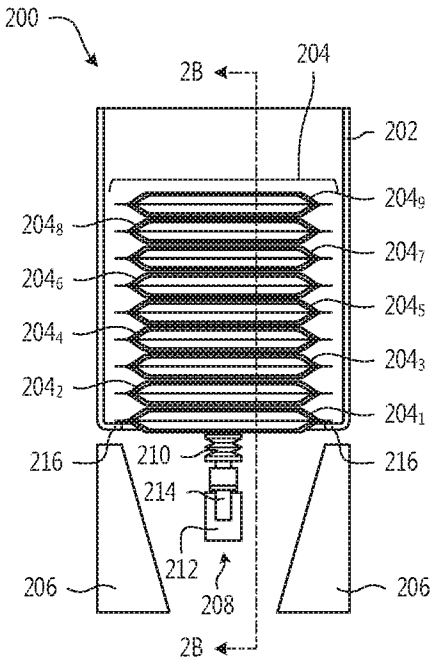

Depicted in FIGS. 2A and 2B are front and cross-sectional side views, respectively, of one instance of a dispenser 200. The dispenser 200 includes a supply structure 202 that holds mailers 204. In the depicted embodiment, the mailers 204 include a mailer $\mathbf{204}_1$, a mailer $\mathbf{204}_2$, a mailer $\mathbf{204}_3$, a mailer $\mathbf{204}_4$, a mailer $\mathbf{204}_5$, a mailer $\mathbf{204}_6$, a mailer $\mathbf{204}_7$, a mailer $\mathbf{204}_8$, and a mailer $\mathbf{204}_9$. When viewing the mailers 204 in the front view shown in FIG. 2A, the two walls of the mailers 204 are on the top and the bottom, the closed sides of the mailers 204 are on the left and right of the mailers 204, and the view is looking through the open ends of the mailers 204 to the closed ends of the mailers 204. When viewing the mailers 204 in the cross-sectional side view shown in FIG. 2B, the two walls of the mailers 204 are on the top and the bottom, the open end of the mailers 204 is on the left, the closed end of the mailers 204 is on the right, and the view is looking through portions of the mailers 204 toward one of the closed sides of the mailers 204.

The supply structure includes tabs 216 that contact the closed sides and the closed end of the mailer $\mathbf{204}_1$. The tabs 216 are arranged so that the tabs 216 support the weight of the mailers 204 in the supply structure 202, but also allow the mailers 204 to be individually pulled out of the supply structure 202 to individually dispense the mailers 204. In the depicted embodiment, the mailer $\mathbf{204}_1$ can be pulled in a downward direction through the tabs 216 to dispense the mailer $\mathbf{204}_1$. In the embodiment shown in FIGS. 2A and 2B, the downward direction is substantially parallel to the open end of the mailers 204. In some embodiments, the mailer $\mathbf{204}_1$ can be dispensed by manually pulling down on the mailer $\mathbf{204}_1$ to pull the mailer through the tabs 216. In some embodiments, the mailer $\mathbf{204}_1$ can be dispensed by a dispensing mechanism that mechanically applied a pulling force downward on the mailer $\mathbf{204}_1$ to pull the mailer $\mathbf{204}_1$ through the tabs 216.

The dispenser 200 includes a biasing structure 206 that is arranged to engage the mailers 204 as the mailers 204 are dispensed from the supply structure 202. In the depicted embodiment, the biasing structure 206 is located below the tabs 216. In this configuration, the downward movement of the mailers 204 as the mailers are being dispensed from the supply structure 202 results in the mailers engaging the biasing structure 206. In the depicted embodiment, the biasing structure 206 has narrowing surfaces contact the sides of the mailers 204 as the mailers 204 are dispensed downward. The narrowing surfaces of the biasing structure 206 are configured to contact the closed sides of the mailers 204 as the mailers 204 are dispensed and the narrowing surfaces are arranged to narrow the open ends of the mailers 204 to cause the open ends to be biased open. In the depicted embodiment, the narrowing surfaces include two planar surfaces arranged with respect to the supply structure 202 so that the sides of the mailers 204 contact the two planar surfaces as the mailers 204 are dispensed from the supply structure 202. The two planar surfaces converge as the two planar surfaces extend in the direction that the mailers 204 are dispensed from the supply structure 202. An example of biasing open one of the mailers 204 as it is dispensed from the supply structure 202 is described below with respect to FIGS. 3A and 3B.

In the depicted embodiment, the dispenser 200 includes a dispensing mechanism 208 that mechanically applies a pulling force downward on one of the mailers 204 to pull the mailer through the tabs 216. The dispensing mechanism 208 includes a coupling device 210 configured to be selectively coupled to one of the mailers 204. In the instance depicted in FIGS. 2A and 2B, the coupling device 210 is coupled to the mailer $\mathbf{204}_1$. The dispensing mechanism 208 also includes a driving wheel 212 that is coupled to the coupling device 210 via a linkage 214. The driving wheel 212 is configured to be moved in a rotary motion (e.g., oscillated) to cause the coupling device 210 to rotate. In the depicted embodiment, the linkage 214 is of a length that oscillation of the driving wheel 212 results in substantially vertical movements of the coupling device 210.

Figure 3B:
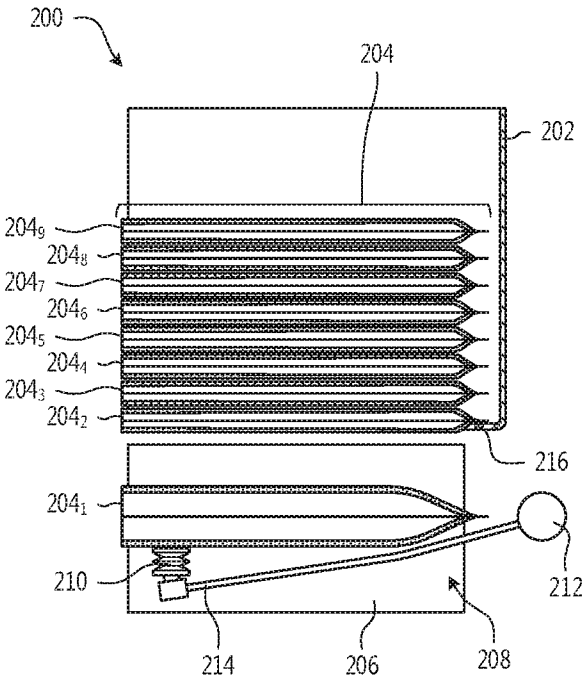
FIGS. 3A and 3B depict are front and cross-sectional side views, respectively, of another instance of the dispenser shown in FIGS. 2A and 2B, in accordance with the embodiments disclosed herein.
Figure 3A:
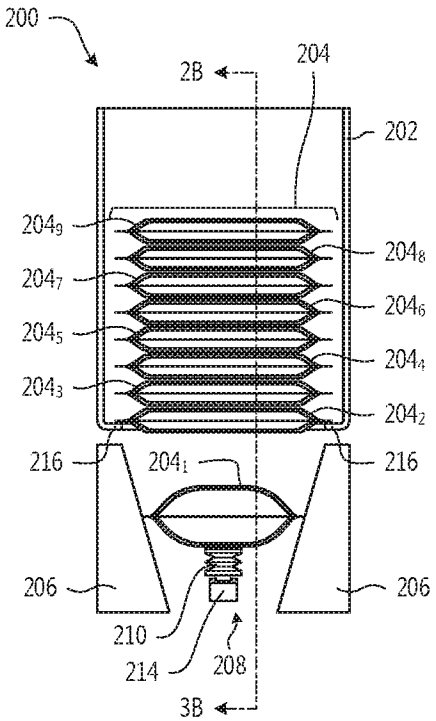

Depicted in FIGS. 3A and 3B are front and cross-sectional side views, respectively, of another instance of the dispenser 200. In the instance shown in FIGS. 3A and 3B, the dispensing mechanism 208 has dispensed the mailer $\mathbf{204}_1$ downward out of the supply structure 202 and into engagement with the biasing structure 206. The narrowing surfaces of the biasing structure 206 have contacted the closed sides of the mailer $\mathbf{204}_1$. As the mailer $\mathbf{204}_1$ was moved downward from its location in the instance shown in FIGS. 2A and 2B to the location in the instance shown in FIGS. 3A and 3B, the narrowing surfaces of the biasing structure 206 further narrowed the open end of the mailer $\mathbf{204}_1$ until the open end of the mailer $\mathbf{204}_1$ was biased open, as shown in FIGS. 3A and 3B.

The dispensing mechanism 208 may hold the mailer $\mathbf{204}_1$ in the position shown in FIGS. 3A and 3B, with the open end of the mailer $\mathbf{204}_1$ biased open, while a user inserts an object into the mailer $204_1$. The user can remove the mailer $204_1$ from the location shown in FIGS. 3A and 3B. In some embodiments, the force applied by the user when removing the mailer $204_1$ decouples the mailer $204_1$ from the coupling device 210. Once the mailer $204_1$ is removed, the dispensing mechanism 208 can move so that the coupling device 210 contacts and couples to the bottom wall of the mailer $204_2$ so that the dispensing mechanism 208 is ready to dispense the mailer $204_2$.

Figure 4:
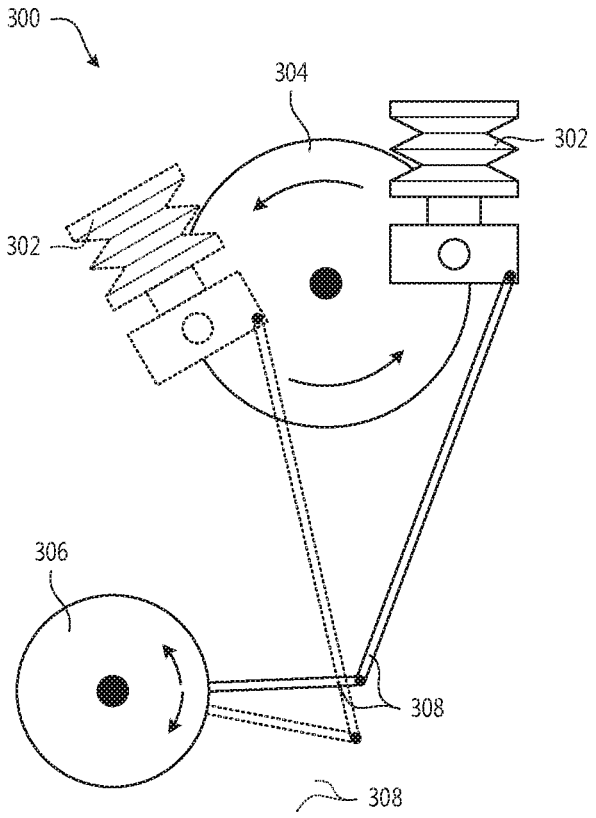
FIG. 4 depicts an embodiment of a dispensing mechanism that can be used in placed of the dispensing mechanism depicted in the dispenser shown in FIGS. 2A and 2B, in accordance with the embodiments disclosed herein.

Another embodiment of a dispensing mechanism 300 is depicted in FIG. 4. The dispensing mechanism 300 includes a coupling device 302 that is rotatably coupled to a first wheel 304. The dispensing mechanism 300 also includes a second wheel 306. The coupling device 302 is coupled to the second wheel 306 via linkages 308. In the depiction in FIG. 4, the coupling device 302 and the linkages 308 are shown in a first position using solid lines and the coupling device 302 and the linkages 308 are shown in a second position using dashed lines.

As can be seen in FIG. 4, the first wheel 304 can rotate in one rotational direction, causing the coupling device 302 to rotate with the first wheel. The vertical motions of the coupling device 302 as the first wheel 304 rotates may cause the coupling device to move upward to contact a mailer, move downward to dispense the mailer from a supply structure, and then move upward again to contact a subsequent mailer in the supply structure. The positioning and/or lengths of the linkages 308 may also cause the coupling device 302 to rotate with respect to the horizon, such as the different angles of the coupling device shown in the two instances depicted in FIG. 4. As the first wheel 304 rotates in complete revolutions, the second wheel 306 oscillates between opposite rotational directions. In some embodiments, the first wheel 304 is driven in rotate in complete revolutions and the second wheel 306 is driven by corresponding movements of the linkages 308. In some embodiments, the second wheel 306 is driven in oscillate between different rotational directions and the first wheel 304 is driven by corresponding movements of the linkages 308.

Figure 5B:
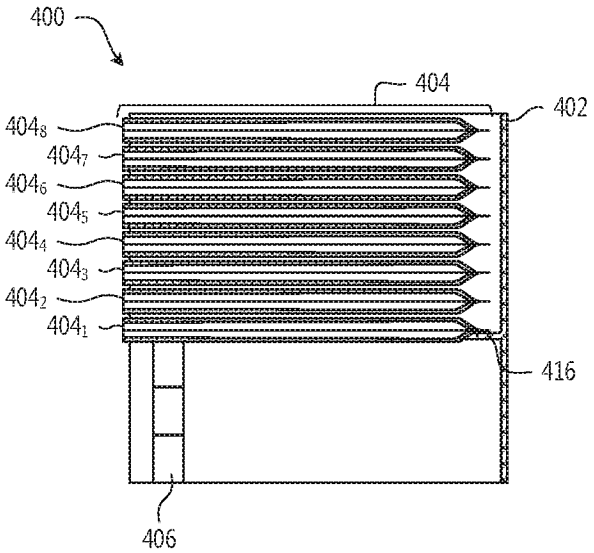
FIGS. 5A and 5B depict front and cross-sectional side views, respectively, of an embodiment of another dispenser, in accordance with the embodiments disclosed herein.
Figure 5A:
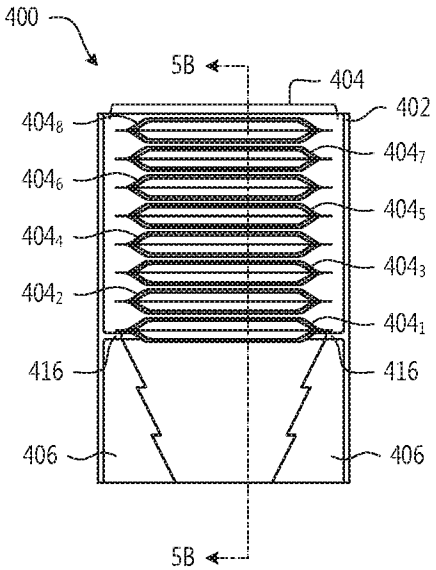

Depicted in FIGS. 5A and 5B are front and cross-sectional side views, respectively, of an embodiment of a dispenser 400. The dispenser 400 includes a supply structure 402 that holds mailers 404. In the depicted embodiment, the mailers 404 include a mailer $404_1$, a mailer $404_2$, a mailer $404_3$, a mailer $404_4$, a mailer $404_5$, a mailer $404_6$, a mailer $404_7$, and a mailer $404_8$. When viewing the mailers 404 in the front view shown in FIG. 2A, the two walls of the mailers 404 are on the top and the bottom, the closed sides of the mailers 404 are on the left and right of the mailers 404, and the view is looking through the open ends of the mailers 404 to the closed ends of the mailers 404. When viewing the mailers 404 in the cross-sectional side view shown in FIG. 4B, the two walls of the mailers 404 are on the top and the bottom, the open end of the mailers 404 is on the left, the closed end of the mailers 404 is on the right, and the view is looking through portions of the mailers 404 toward one of the closed sides of the mailers 404.

The supply structure includes tabs 416 that contact the closed sides and the closed end of the mailer $404_1$. The tabs 416 are arranged so that the tabs 416 support the weight of the mailers 404 in the supply structure 402, but also allow the mailers 404 to be individually pulled out of the supply structure 402 to individually dispense the mailers 404. In the depicted embodiment, the mailer $404_1$ can be pulled in a downward direction through the tabs 416 to dispense the mailer $404_1$. In the embodiment shown in FIGS. 4A and 4B, the downward direction is substantially parallel to the open end of the mailers 404. In some embodiments, the mailer $404_1$ can be dispensed by manually pulling down on the mailer $404_1$ to pull the mailer through the tabs 416. In some embodiments, the mailer $404_1$ can be dispensed by a dispensing mechanism that mechanically applied a pulling force downward on the mailer $404_1$ to pull the mailer $404_1$ through the tabs 416.

The dispenser 400 includes a biasing structure 406 that is arranged to engage the mailers 404 as the mailers 404 are dispensed from the supply structure 402. In the depicted embodiment, the biasing structure 406 is located below the tabs 416. In this configuration, the downward movement of the mailers 404 as the mailers are being dispensed from the supply structure 402 results in the mailers engaging the biasing structure 406. In the depicted embodiment, the biasing structure 406 has narrowing surfaces contact the sides of the mailers 404 as the mailers 404 are dispensed downward. The narrowing surfaces of the biasing structure 406 are configured to contact the closed sides of the mailers 404 as the mailers 404 are dispensed and the narrowing surfaces are arranged to narrow the open ends of the mailers 404 to cause the open ends to be biased open. In the depicted embodiment, the narrowing surfaces include linear ratcheting surfaces resist motion of the mailers 404 toward the supply structure 402 at points in the direction that the mailers 404 are dispensed from the supply structure 402. At one of the point where the linear ratcheting surfaces resist motion of the mailer toward the supply structure, the linear ratcheting surfaces are arranged to cause the open end of the mailer to be biased open.

Figure 6B:
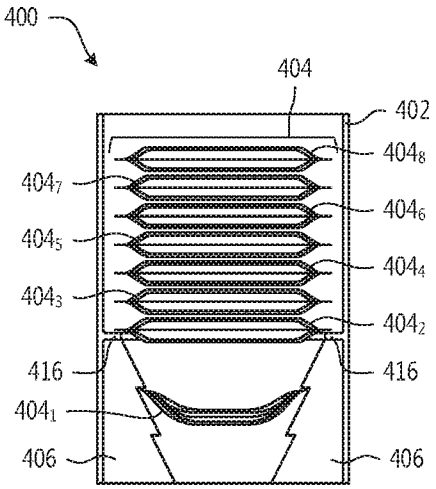
FIG. 6B depicts one example of a problem that can occur when dispensing mailers into biasing structures, in accordance with the embodiments disclosed herein.
Figure 6A:
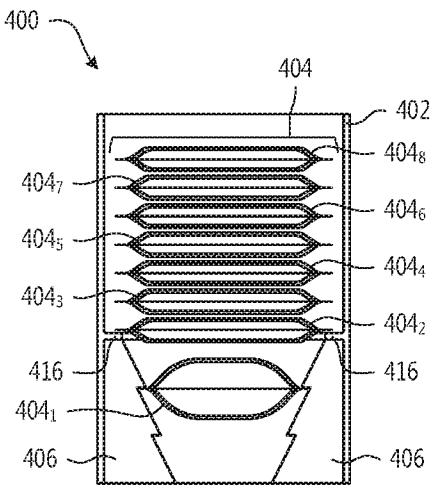
FIG. 6A depicts one example of a mailer having been dispensed from the supply structure of the dispenser depicted in FIGS. 5A and 5B and being biased open by the linear ratcheting surfaces of the biasing structure of the dispenser depicted in FIGS. 5A and 5B, in accordance with the embodiments disclosed herein.

One example of the mailer $404_1$ having been dispensed from the supply structure 402 and being biased open by the linear ratcheting surfaces of the biasing structure 406 is depicted in FIG. 6A. In that instance, the mailer $404_1$ has been moved downward so that the closed sides of the mailer $404_1$ are contacting the linear ratcheting surfaces of the biasing structure 406. The linear ratcheting surfaces of the biasing structure 406 are biasing open the open end of the mailer $404_1$. From the point where the mailer $404_1$ is located in FIG. 4, the linear ratcheting surfaces of the biasing structure 406 are also resisting upward motion of the mailer $404_1$ toward the supply structure 402. Because narrowing surfaces of the biasing structure 406 are wider closer to the tabs 416 of the supply structure, the narrowing surfaces impart some upward force on the closed sides of the mailer $404_1$. Point along the linear ratcheting surfaces are toothed to overcome the upward force on the mailer $404_1$ and resist upward movement of the mailer $404_1$ toward the supply structure 402.

One example of a problem that can occur when dispensing mailers into biasing structures is depicted in FIG. 6B. In the depicted example, the two walls of the mailer $404_1$ ended up on the same side of the closed sides of the mailer $404_1$. More specifically, in the depicted example, the top and bottom walls of the mailer $404_1$ ended up below the sides of the mailer $404_1$ that are engaged with the linear ratcheting surface of the biasing structure 406. In this orientation, the mailer $404_1$ is not biased open. Instead, the orientation of the mailer $404_1$ in FIG. 6B may create more difficulties for a user to insert an object in the mailer $404_1$ than if the biasing structure 406 was not used.

Figure 7B:
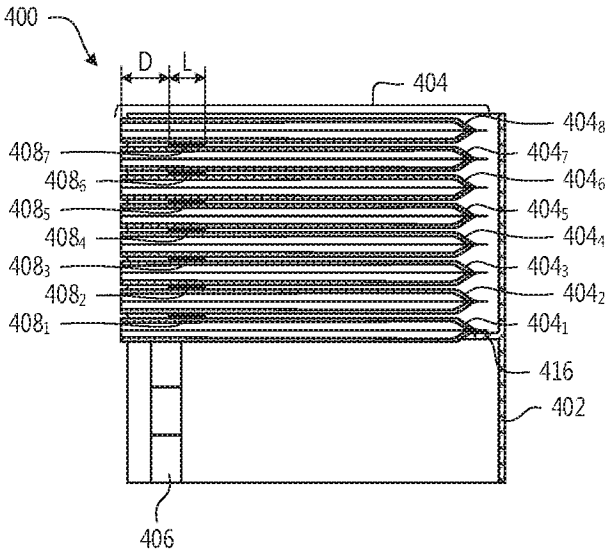
FIGS. 7A and 7B depict front and front and cross-sectional side views, respectively, of the dispenser shown in FIGS. 5A and 5B with the mailers arranged to address the problem depicted in FIG. 6B, in accordance with the embodiments disclosed herein.
Figure 7A:
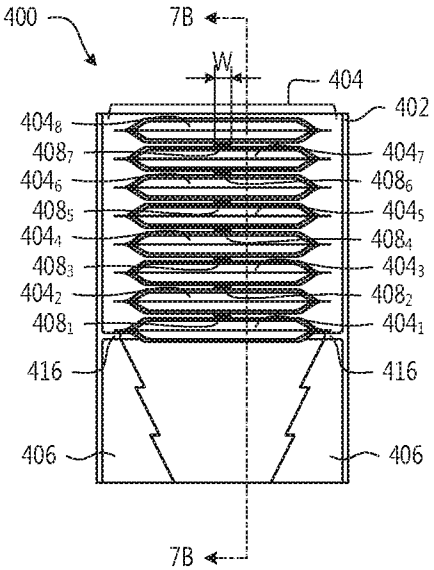

Depicted in FIGS. 7A and 7B are front and front and cross-sectional side views, respectively, of the dispenser 400 with the mailers 404 arranged to address the problem depicted in FIG. 6B. More specifically, each pair of subsequent mailers in the supply structure 402 are adhered to each other. In the specific example depicted in FIGS. 7A and 7B, the top wall of the mailer 404$_1$ is adhered to the bottom wall of the mailer 404$_2$ by a dot adhesive 408$_1$, the top wall of the mailer 404$_2$ is adhered to the bottom wall of the mailer 404$_3$ by a dot adhesive 408$_2$, the top wall of the mailer 404$_3$ is adhered to the bottom wall of the mailer 404$_4$ by a dot adhesive 408$_3$, the top wall of the mailer 404$_4$ is adhered to the bottom wall of the mailer 404$_5$ by a dot adhesive 408$_4$, the top wall of the mailer 404$_5$ is adhered to the bottom wall of the mailer 404$_6$ by a dot adhesive 408$_5$, the top wall of the mailer 404$_6$ is adhered to the bottom wall of the mailer 404$_7$ by a dot adhesive 408$_6$, and the top wall of the mailer 404$_7$ is adhered to the bottom wall of the mailer 404$_8$ by a dot adhesive 408$_7$.

The dot adhesives 408$_1$, 408$_2$, 408$_3$, 408$_4$, 408$_5$, 408$_6$, and 408$_7$ (collectively, dot adhesives 408) may have any form or shape, such as a circular disc, a rectangular prism, or any other shape or form. The location and or size of the dot adhesives 408 between the subsequent pairs of the mailers 404 may be select to encourage the mailers 404 to remain adhered while in the supply structure 402 but then separate from each other when the mailers 404 are dispensed.

Figure 7D:
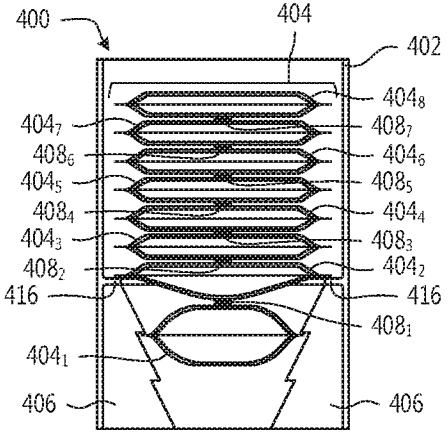
FIGS. 7C to 7G depict an example of a series of instances showing how the dot adhesives between mailers can help to avoid the problem shown in FIG. 6B, in accordance with the embodiments disclosed herein.
Figure 7C:
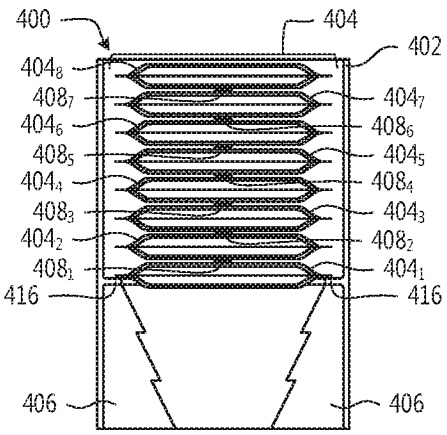

An example of how the dot adhesives 408 can help to avoid the problem shown in FIG. 6B is depicted in a series of instances shown in FIGS. 7C to 7G. In FIG. 7C, the mailers 404 are all in the supply structure 402. From the instance depicted in FIG. 7C to the instance depicted in FIG. 7D, the mailer 404$_1$ has been pulled down to the point at which the mailer 404$_1$ is biased open by the linear ratcheting surfaces of the biasing structure 406 and the linear ratcheting surfaces of the biasing structure 406 resists motion of the mailer 404$_1$ upward toward the supply structure 402. At the instance shown in FIG. 7D, dot adhesive 408$_1$ continues to adhere the top wall of the mailer 404$_1$ to the bottom wall of mailer 404$_2$. This results in the top wall of the mailer 404$_1$ being lifted upward by the bottom wall of mailer 404$_2$ and the bottom wall of mailer 404$_2$ being pulled downward by the top wall of the mailer 404$_1$. In this way, the mailer 404$_1$ is more likely to be biased open by the biasing structure 406 instead of ending up in the orientation shown in FIG. 6B.

Figure 7G:
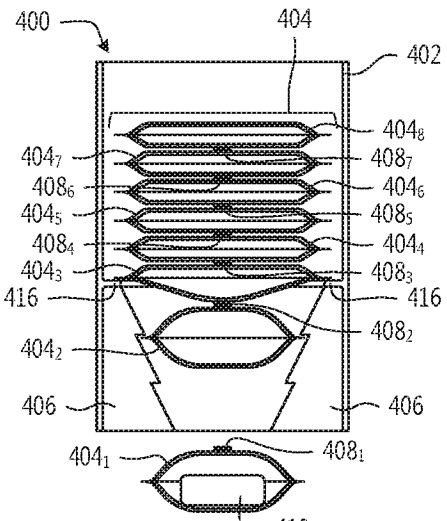
Figure 7F:
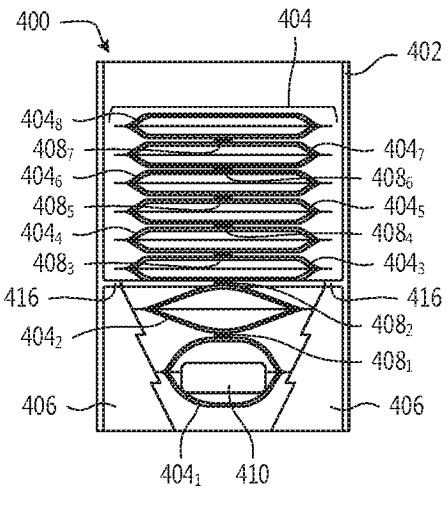
Figure 7E:
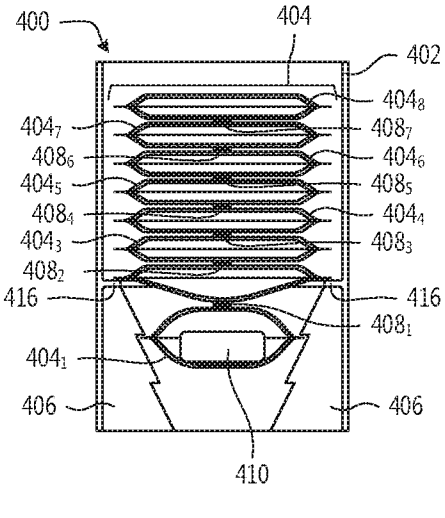

After the mailer 404$_1$ is in the position shown in FIG. 7D, a user can insert an object 410 into the mailer 404$_1$, as shown in FIG. 7E. In the depicted embodiment, the object 410 is a single item to be packaged in the mailer 404$_1$. In other embodiments, the object 410 may include multiple items to be packaged in the mailer 404$_1$. In the depicted embodiment, the object 410 was inserted while the mailer 404$_1$ was located in the biasing structure 406. In other embodiments, it is possible for the mailer 404$_1$ to be removed from the biasing structure 406 before the object 410 is inserted.

After the object is inserted into the mailer 404$_1$, the mailer 404$_1$ can be pulled through the biasing structure 406 further, as shown in FIG. 7F. Because the mailer 404$_1$ is still adhered to the mailer 404$_2$, the downward movement of the mailer 404$_1$ causes the mailer 404$_2$ to be dispensed from the supply structure 402 past the tabs 416 so that the closed sides of the mailer 404$_2$ begin to engage the biasing structure 406. From the position shown in FIG. 7F, the mailer 404$_1$ can be pulled out of the biasing structure 406, as shown in FIG. 7G. The amount of force to pull the mailer 404$_1$ out of the biasing structure 406 may be more than the dot adhesive 408$_1$ is able to withstand such that the dot adhesive 408$_1$ is pulled off of one or both of the mailers 404$_1$ or 404$_2$. In the instance shown in FIG. 7G, the dot adhesive 408$_1$ has been pulled off of the mailer 404$_2$ and the dot adhesive 408$_1$ remains on the mailer 404$_1$. In other examples, the dot adhesive 408$_1$ may be pulled off of the mailer 404$_1$ and the dot adhesive 408$_1$ may remain on the mailer 404$_2$.

In some embodiments, characteristics of the dot adhesives 408 may be selected to increase the likelihood that the dot adhesives 408 will remain adhered to mailers when desired and then will pull off of mailers when desired. The characteristics selected may include the type of material of the dot adhesives 408, the size of the dot adhesives 408, or the location of the dot adhesives 408 between pairs of the mailers 404. In some embodiments, the material may be a tack adhesive, such as DOT SHOT adhesive dots, model no. S-10367, produced by Uline, Inc., of Pleasant Prairie, Wis. In some embodiments, the size of the dot adhesives 408 may be selected to have a particular length L (e.g., 0.25 inches) or a particular width (e.g., 0.25 inches). In some embodiments, the dot adhesives 408 may be selected based on a surface area (e.g., 0.05 in$^2$) of the dot adhesives 408 that contacts the mailers 404. In some embodiments, the location of the dot adhesives 408 may be substantially equidistantly between the two closed sides of the pairs of mailers. In some embodiments, the distance D from the open end of the mailer to the dot adhesives 408 may be in a range between about 2 inches and about 6 inches, such as a distance D of about 5 inches.

Figure 8B:
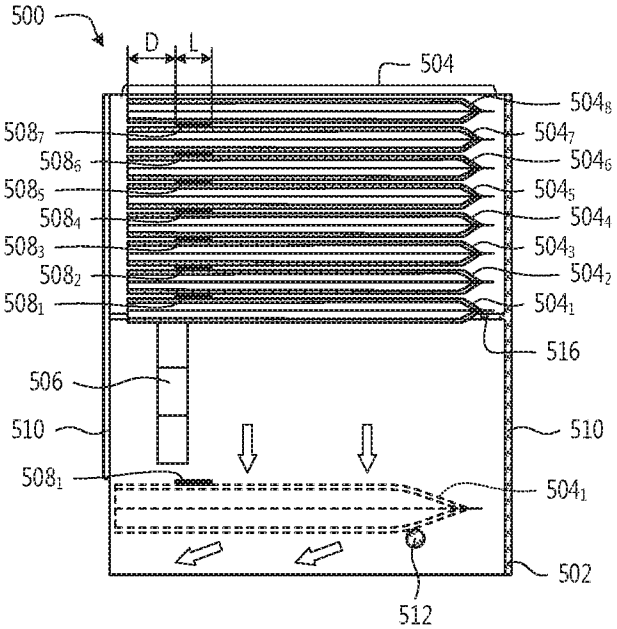
FIGS. 8A and 8B depict front and cross-sectional side views, respectively, of an embodiment of another dispenser, in accordance with the embodiments disclosed herein.
Figure 8A:
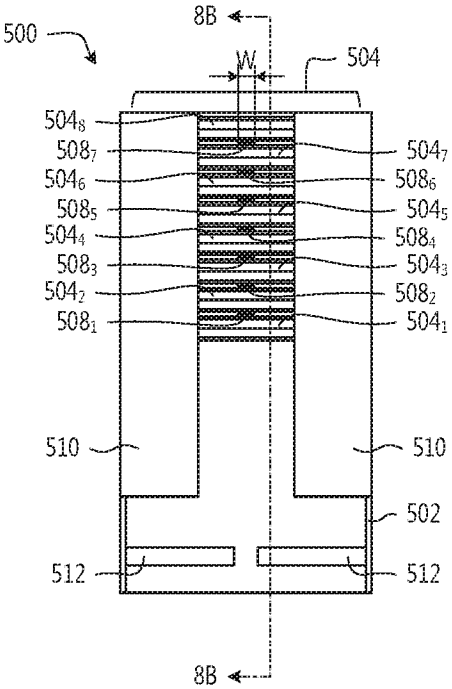

It would be advantageous to increase the likelihood that mailers that are adhered to each other with a dot adhesive separate from each other at the appropriate time. Depicted in FIGS. 8A and 8B are front and cross-sectional side views, respectively, of an embodiment of a dispenser 500. The dispenser 500 includes a supply structure 502 that holds mailers 504. In the depicted embodiment, the mailers 504 include a mailer 504$_1$, a mailer 504$_2$, a mailer 504$_3$, a mailer 504$_4$, a mailer 504$_5$, a mailer 504$_6$, a mailer 504$_7$, and a mailer 504$_8$. When viewing the mailers 504 in the front view shown in FIG. 8A, the two walls of the mailers 504 are on the top and the bottom, the closed sides of the mailers 504 are on the left and right of the mailers 504, and the view is looking through the open ends of the mailers 504 to the closed ends of the mailers 504. When viewing the mailers 504 in the cross-sectional side view shown in FIG. 8B, the two walls of the mailers 504 are on the top and the bottom, the open end of the mailers 504 is on the left, the closed end of the mailers 504 is on the right, and the view is looking through portions of the mailers 504 toward one of the closed sides of the mailers 504.

The supply structure includes tabs 516 that contact the closed sides and the closed end of the mailer 504$_1$. The tabs 516 are arranged so that the tabs 516 support the weight of the mailers 504 in the supply structure 502, but also allow the mailers 504 to be individually pulled out of the supply structure 502 to individually dispense the mailers 504. In the depicted embodiment, the mailer 504$_1$ can be pulled in a downward direction through the tabs 516 to dispense the mailer 504$_1$. In the embodiment shown in FIGS. 5A and 5B, the downward direction is substantially parallel to the open end of the mailers 504.

The dispenser 500 includes a biasing structure 506 that is arranged to engage the mailers 504 as the mailers 504 are dispensed from the supply structure 502. In the depicted embodiment, the biasing structure 506 is located below the tabs 516. In this configuration, the downward movement of the mailers 504 as the mailers are being dispensed from the supply structure 502 results in the mailers 504 engaging the biasing structure 506. In the depicted embodiment, the biasing structure 506 has narrowing surfaces contact the sides of the mailers 504 as the mailers 504 are dispensed downward. The narrowing surfaces of the biasing structure 506 are configured to contact the closed sides of the mailers 504 as the mailers 504 are dispensed and the narrowing surfaces are arranged to narrow the open ends of the mailers 504 to cause the open ends to be biased open. In the depicted embodiment, the narrowing surfaces include linear ratcheting surfaces resist motion of the mailers 504 toward the supply structure 502 at points in the direction that the mailers 504 are dispensed from the supply structure 502. At one of the point where the linear ratcheting surfaces resist motion of the mailer toward the supply structure, the linear ratcheting surfaces are arranged to cause the open end of the mailer to be biased open.

In the specific example depicted in FIGS. 8A and 8B, the top wall of the mailer $\mathbf{504}_1$ is adhered to the bottom wall of the mailer $\mathbf{504}_2$ by a dot adhesive $\mathbf{508}_1$, the top wall of the mailer $\mathbf{504}_2$ is adhered to the bottom wall of the mailer $\mathbf{504}_3$ by a dot adhesive $\mathbf{508}_2$, the top wall of the mailer $\mathbf{504}_3$ is adhered to the bottom wall of the mailer $\mathbf{504}_4$ by a dot adhesive $\mathbf{508}_3$, the top wall of the mailer $\mathbf{504}_4$ is adhered to the bottom wall of the mailer $\mathbf{504}_5$ by a dot adhesive $\mathbf{508}_4$, the top wall of the mailer $\mathbf{504}_5$ is adhered to the bottom wall of the mailer $\mathbf{504}_6$ by a dot adhesive $\mathbf{508}_5$, the top wall of the mailer $\mathbf{504}_6$ is adhered to the bottom wall of the mailer $\mathbf{504}_7$ by a dot adhesive $\mathbf{508}_6$, and the top wall of the mailer $\mathbf{504}_7$ is adhered to the bottom wall of the mailer $\mathbf{504}_8$ by a dot adhesive $\mathbf{508}_7$. The dot adhesives $\mathbf{508}_1$, $\mathbf{508}_2$, $\mathbf{508}_3$, $\mathbf{508}_4$, $\mathbf{508}_5$, $\mathbf{508}_6$, and $\mathbf{508}_7$ are collectively referred to as dot adhesives 508.

The supply structure 502 of the dispenser 500 includes flanges 510 that are located in front of portions of the open ends of the mailer 504. The flanges 510 can aid in ensuring that, when one of the mailers 504 is dispensed from the supply structure 502, the dispensed mailer separates from the subsequent mailer. For example, the mailer $\mathbf{504}_1$ can be pulled down out of the supply structure 502 and through the biasing structure 506 to the point shown in dashed lines in FIG. 8B. From that point, the mailer $\mathbf{504}_1$ can be slid and/or rotated forward so that the front end of the mailer $\mathbf{504}_1$ passes under the flanges 510. As the mailer $\mathbf{504}_1$ passes under the flanges 510 while the mailer $\mathbf{504}_1$ is still adhered to the mailer $\mathbf{504}_2$ by the dot adhesive $\mathbf{508}_1$, the mailer $\mathbf{504}_2$ contacts the flanges 510, thereby imparting shear stress to the dot adhesive $\mathbf{508}_1$ until the dot adhesive $\mathbf{508}_1$ is no longer adhered to one or both of the mailers $\mathbf{502}_1$ and $\mathbf{502}_2$. In the depicted embodiment, the supply structure 502 includes posts 512 that are configured to cause rotation of the mailer $\mathbf{504}_1$ as the mailer $\mathbf{504}_1$ is dispensed from the supply structure 502 (e.g., when the mailer $\mathbf{504}_1$ is in the location shown in dashed lines in FIG. 8B). In some embodiments, the posts 512 are static posts, such as a rod or a dowel. In some embodiments, the posts 512 are rollers that have an exterior that can rotate freely as an object passes by the posts 512.

Figure 9B:
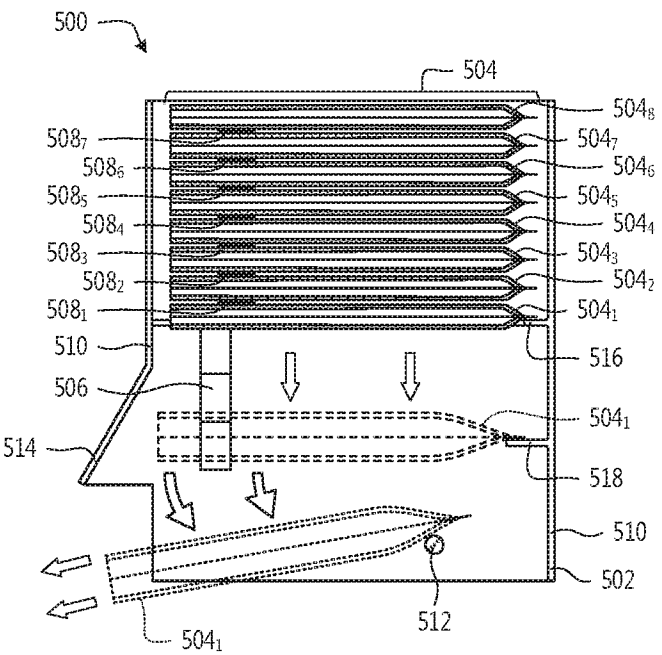
FIGS. 9A and 9B depict front and cross-sectional side views, respectively, of a variation of the dispenser depicted in FIGS. 8A and 8B, in accordance with the embodiments disclosed herein.
Figure 9A:
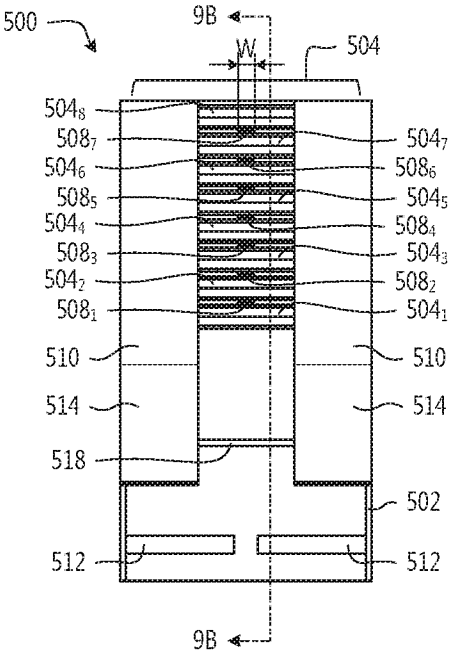

Depicted in FIGS. 9A and 9B are front and cross-sectional side views, respectively, of a variation of the dispenser 500. In FIGS. 9A and 9B, the flanges 510 include flared portions 514 that extend outward from the open ends of the mailers 504 in the supply structure 502. The flared portions 514 are located at about the position of the biasing structure 506. The flared portions 514 may accommodate for deformation of the mailers 504 as they are biased opened by the biasing structure 506 and/or as the mailers 504 are filled while they are in the biasing structure 506. The supply structure 502 also includes a separation tab 518 located at or near the bottom of the biasing structure 506. In the depicted embodiment, the separation tab 518 extends out further than the tabs 516. When the mailer $\mathbf{504}_1$ reaches the location shown in FIG. 9B using dashed lines, the separation tab 518 encourages rotation of the mailer $\mathbf{504}_1$. The mailer $\mathbf{504}_1$ can then be moved to the location shown in FIG. 9B using dotted lines, where the mailer $\mathbf{504}_1$ can then be slid out underneath the flanges 510.

Figure 10C:
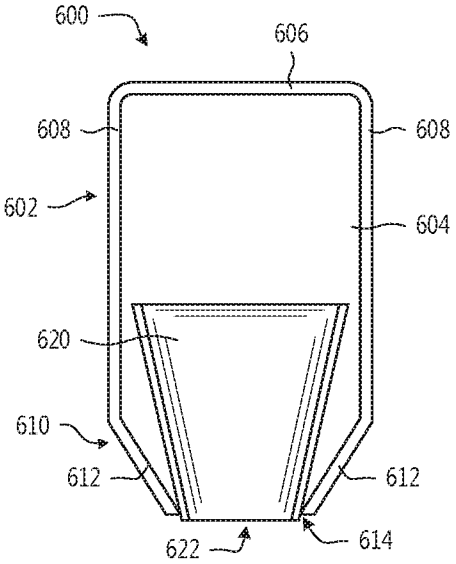
FIGS. 10C and 10D depict top and front views, respectively, of another instance of the dispenser depicted in FIGS. 10A and 10B, in accordance with the embodiments disclosed herein.
Figure 10D:
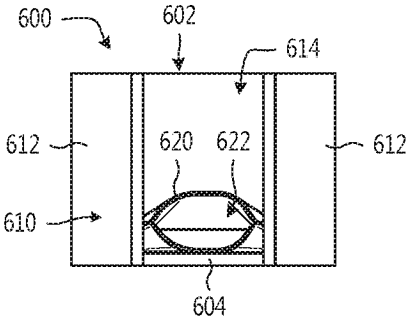
Figure 10A:
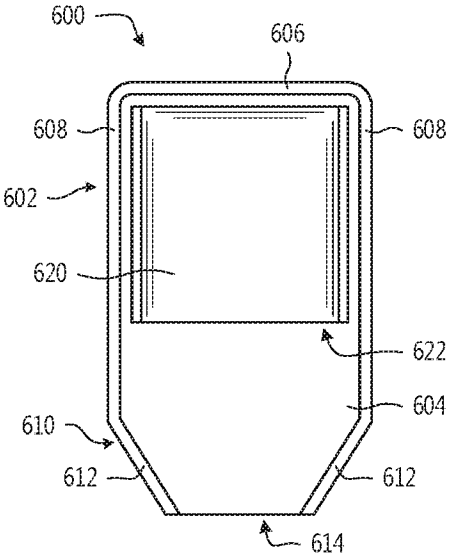
FIGS. 10A and 10B depict top and front views, respectively, of one instance of an embodiment of a dispenser, in accordance with the embodiments disclosed herein.
Figure 10B:
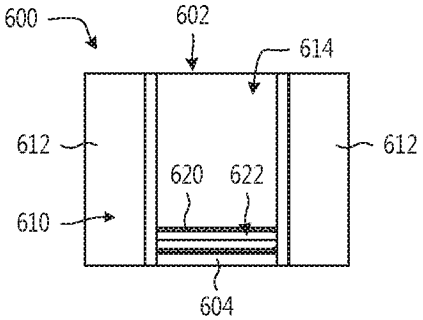

Depicted in FIGS. 10A and 10B are top and front views, respectively, of one instance of an embodiment of a dispenser 600. The dispenser 600 includes a supply structure 602. In the depicted embodiment, the supply structure 602 includes a bottom surface 604, a rear wall 606 extended upward from the bottom surface 604 at the rear end of the dispenser 600, and side walls 608 that extend upward from the sides of the bottom surface 604. In the depicted embodiment, each of the side walls 608 is coupled to the rear wall 606. The dispenser 600 also includes a biasing structure 610. The biasing structure 610 includes narrowing surfaces 612. In the depicted embodiment, each of the narrowing surfaces 612 is coupled to one of the side walls 608. The narrowing surfaces 612 do not meet at the front end of the dispenser 600 so that a gap 614 exists between the narrowing surfaces 612.

The supply structure 602 is configured to hold mailers. In the depicted embodiment, the supply structure 602 is holding a mailer 620. Additional mailers can be held by the supply structure 602, such as a stack of mailers that are placed on top of the mailer 620. In the depicted embodiment, only the mailer 620 is shown for convenience in viewing the dispenser 600. When viewing the mailer 620 in the top view shown in FIG. 10A, the one wall of the mailer 620 is visible, the open end of the mailer 620 is on the bottom, the closed end of the mailer 620 is on the top, and the closed sides of the mailer 620 are located on the left and the right. When viewing the mailer 620 in the front view shown in FIG. 10B, the two walls of the mailer 620 are on the top and the bottom, the closed sides of the mailer 620 obscured by the narrowing surfaces 612 but are on the left and right of the mailer 620 behind the narrowing surfaces 612, and the view is looking through the open end 622 of the mailer 620 to the closed end of the mailer 620.

Before the mailer 620 is dispensed from the dispenser 600, the mailer 620 is supported by the bottom surface 604 of the supply structure 602. The mailer 620 is capable be being dispensed from the supply structure 602 by moving the mailer 620 toward the biasing structure 610 and the gap 614 between the narrowing surfaces 612 of the biasing structure 610. In the embodiment shown in FIGS. 10A and 10B, the direction that the mailer 620 is dispensed is substantially perpendicular to the open end 622 of the mailer 620. The dispenser 600 is configured to permit the mailer 620 to be manually pulled or pushed to dispense the mailer 620 from the supply structure 602. In other embodiments, the dispenser 600 may be configured to mechanically pull or push the mailer 620 to dispense the mailer 620 from the supply structure 602.

The biasing structure 610 is arranged to engage the mailer 620 as the mailer 620 is dispensed from the supply structure 602. In the depicted embodiment, the biasing structure 610 is located in front of the supply structure 602. In this configuration, the forward movement of the mailer 620 as the mailer 620 is being dispensed from the supply structure 602 results in the mailer 620 engaging the biasing structure 610. In the depicted embodiment, the narrowing surfaces 612 contact the sides of the mailer 620 as the mailer 620 is dispensed forward. The narrowing surfaces 612 of the biasing structure 610 are configured to contact the closed sides of the mailer 620 as the mailer 620 is dispensed and the narrowing surfaces 612 are arranged to narrow the open end 622 of the mailer 620 to cause the open end 622 to be biased open. In the depicted embodiment, the narrowing surfaces 612 include two planar surfaces arranged with respect to the supply structure 602 so that the sides of the mailer 620 contact the two planar surfaces as the mailer 620 is dispensed from the supply structure 602. The two planar surfaces converge as the two planar surfaces extend in the direction that the mailer 620 is dispensed from the supply structure 602.

Depicted in FIGS. 10C and 10D are top and front views, respectively, of another instance of the dispenser 600 where the open end 622 of the mailer 620 is biased open by the narrowing surfaces 612 of the biasing structure 610. Between the instance depicted in FIGS. 10A and 10B and the instance depicted in FIGS. 10C and 10D, the mailer 620 has been pulled forward and the narrowing surfaces 612 of the biasing structure 610 have engaged the closed sides of the mailer 620. The open end 622 of the mailer 620 has been brought forward to the gap 614 between the narrowing surfaces 612. At this location, the narrowing surfaces 612 narrow the open end 622 of the mailer 620 to cause the open end 622 to be biased open.

At the location of the mailer 620 in FIGS. 10C and 10D, a user can insert an object into the mailer 620 through the open end 622 of the mailer 620. Inserting the object into the mailer 620 while the open end 622 of the mailer 620 is biased open may decrease the amount of time that it takes a user to insert the object in the mailer 620, thereby increasing efficiency of the user's operation. From the position shown in FIGS. 10C and 10D, the mailer 620 can be pulled further forward until the mailer 620 is pulled entirely through the gap 614 between the narrowing surfaces 612. At that point, the open end 622 of the mailer 620 can be closed.

Figure 11A:
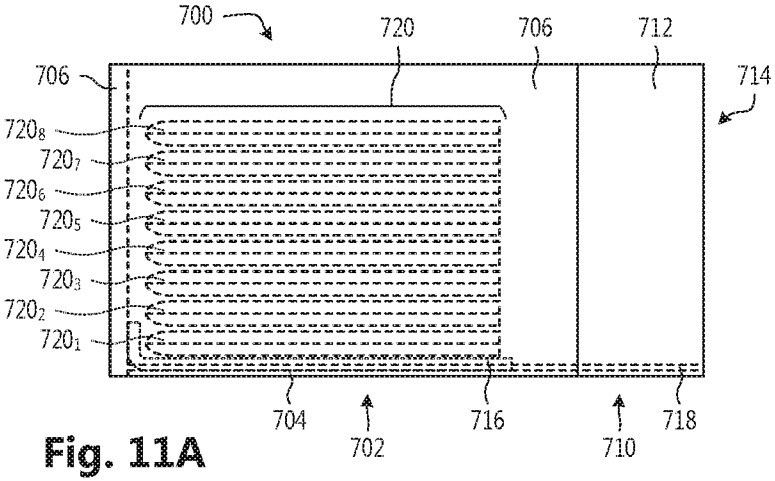
FIGS. 11A and 11B depict side and top views, respectively, of one instance of an embodiment of a dispenser, in accordance with the embodiments disclosed herein.
Figure 11B:
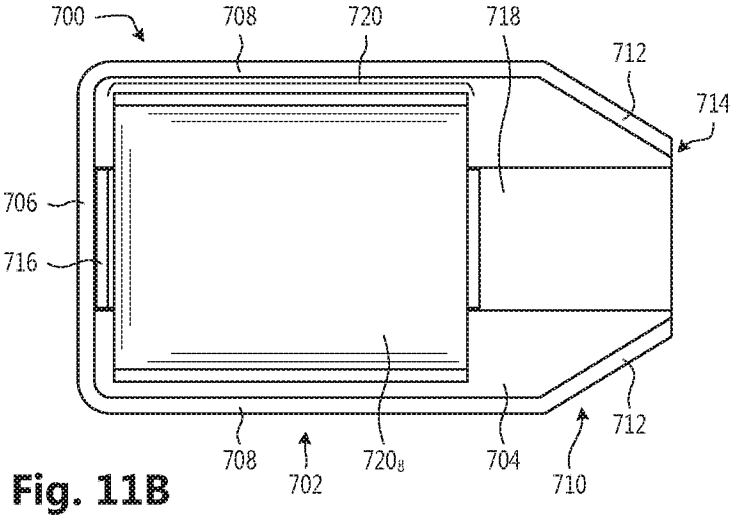

Depicted in FIGS. 11A and 11B are side and top views, respectively, of one instance of an embodiment of a dispenser 700. The dispenser 700 includes a supply structure 702. In the depicted embodiment, the supply structure 702 includes a bottom surface 704, a rear wall 706 extended upward from the bottom surface 704 at the rear end of the dispenser 700, and side walls 708 that extend upward from the sides of the bottom surface 704. In the depicted embodiment, each of the side walls 708 is coupled to the rear wall 706. The dispenser 700 also includes a biasing structure 710. The biasing structure 710 includes narrowing surfaces 712. In the depicted embodiment, each of the narrowing surfaces 712 is coupled to one of the side walls 708. The narrowing surfaces 712 do not meet at the front end of the dispenser 700 so that a gap 714 exists between the narrowing surfaces 712.

The supply structure 702 is configured to hold mailers 720. In the depicted embodiment, the mailers 720 include a mailer $720_1$, a mailer $720_2$, a mailer $720_3$, a mailer $720_4$, a mailer $720_5$, a mailer $720_6$, a mailer $720_7$, and a mailer $720_8$. When viewing the mailers 720 in the side view shown in FIG. 10A, the two walls of the mailers 720 are on the top and the bottom, the closed ends of the mailers 720 are on the left, and the open ends of the mailers 720 are on the right. When viewing the mailers 720 in the top view shown in FIG. 11B, one wall of the mailer $720_8$ is visible, the open end of the mailer $720_8$ is on the right, the closed end of the mailer $720_8$ is on the left, and the closed sides of the mailer $720_8$ are located on the top and the bottom.

The mailers 720 are capable be being dispensed from the supply structure 702 by moving the mailers 720 individually toward the biasing structure 710 and the gap 714 between the narrowing surfaces 712 of the biasing structure 710. In the embodiment shown in FIGS. 11A and 11B, the direction that the mailers 720 are dispensed is substantially perpendicular to the open ends the mailers 720. As will be discussed in greater detail below, the dispenser 700 is configured to mechanically push the mailers 720 individually to dispense the mailers 720 from the supply structure 702. In other embodiments, the dispenser 700 may be configured to permit the mailers 720 to be manually pulled or pushed individually to dispense the mailers 720 from the supply structure 702.

The biasing structure 710 is arranged to engage the mailers 720 as the mailers 720 are dispensed from the supply structure 702. In the depicted embodiment, the biasing structure 710 is located in front of the supply structure 702. In this configuration, the forward movement of the mailers 720 as the mailers 720 are being dispensed from the supply structure 702 results in the mailers 720 engaging the biasing structure 710. In the depicted embodiment, the narrowing surfaces 712 contact the sides of the mailers 720 as the mailers 720 are dispensed forward. The narrowing surfaces 712 of the biasing structure 710 are configured to contact the closed sides of the mailers 720 as the mailers 720 are dispensed and the narrowing surfaces 712 are arranged to narrow the open ends of the mailers 720 to cause the open ends to be biased open. In the depicted embodiment, the narrowing surfaces 712 include two planar surfaces arranged with respect to the supply structure 702 so that the sides of the mailers 720 contact the two planar surfaces as the mailers 720 is dispensed from the supply structure 702. The two planar surfaces converge as the two planar surfaces extend in the direction that the mailers 720 are dispensed from the supply structure 702.

The dispenser 700 includes a pushing mechanism 716. The pushing mechanism 716 is configured to push the mailers 720 individually from the supply structure 702 in the direction that is substantially perpendicular to the open ends of the mailers 720 until the open end of the mailer at least reaches the gap 714 between the narrowing surfaces 714 of the biasing structure 710. In the depicted embodiment, the pushing mechanism 716 is in the form of a tray that is located in a trough 718 in the bottom surface 704 of the supply structure. The trough 718 is arranged to guide the tray as it is moved to dispense one of the mailer 720 out of the supply structure 702. In the depicted embodiment, the tray is configured to contact a closed end of one of the mailers 720 so that, as the tray is pushed forward, the closed end of the one of the mailers 720 is pushed forward.

Figure 11C:
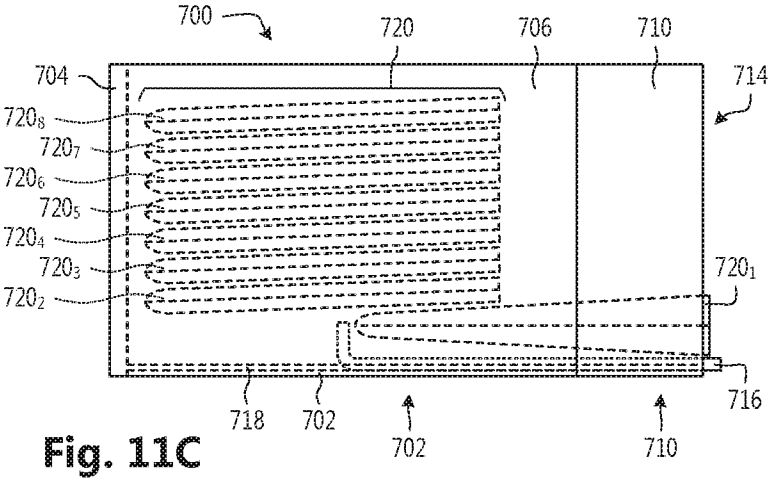
FIGS. 11C and 11D depict side and top views, respectively, of another instance of the dispenser depicted in FIGS. 11A and 11B, in accordance with the embodiments disclosed herein.
Figure 11D:
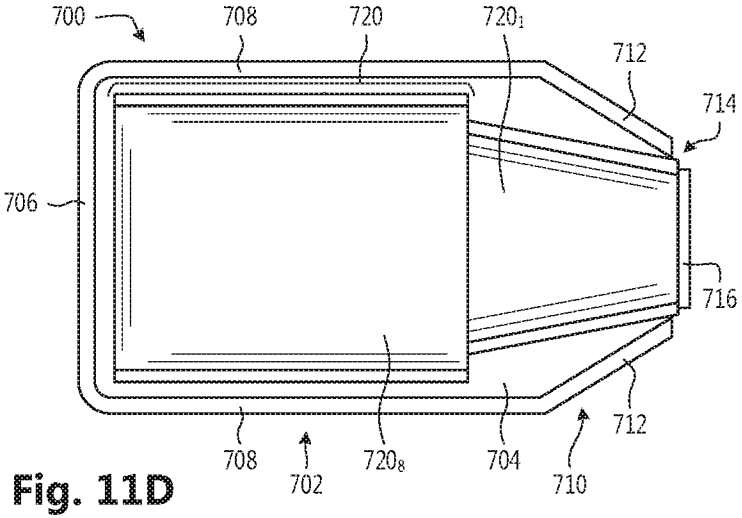

Depicted in FIGS. 11C and 11D are side and top views, respectively, of another instance of the dispenser 700 where the open end of the mailer $720_1$ is biased open by the narrowing surfaces 712 of the biasing structure 710. Between the instance depicted in FIGS. 11A and 11B and the instance depicted in FIGS. 11C and 11D, the mailer $720_1$ has been pushed forward by the pushing mechanism 716 and the narrowing surfaces 712 of the biasing structure 710 have engaged the closed sides of the mailer $720_1$. The open end of the mailer 720 has been brought forward to the gap 714 between the narrowing surfaces 712. At this location, the narrowing surfaces 712 narrow the open end of the mailer 720 to cause the open end to be biased open.

At the location of the mailer $720_1$ in FIGS. 11C and 11D, a user can insert an object into the mailer $720_1$ through the open end of the mailer $720_1$. Inserting the object into the mailer $720_1$ while the open end of the mailer $720_1$ is biased open may decrease the amount of time that it takes a user to insert the object in the mailer $720_1$, thereby increasing efficiency of the user's operation. From the position shown in FIGS. 11C and 11D, the mailer $720_1$ can be pulled further forward until the mailer 720 is pulled entirely through the gap 714 between the narrowing surfaces 712. At that point, the open end of the mailer $720_1$ can be closed.

After the mailer $720_1$ is removed from the narrowing surfaces 712, the pushing mechanism 716 can be returned to the position shown in FIGS. 11A and 11B. At that point, the mailers 720 that remain in the supply structure 702 fall downward so that the mailer $720_2$ falls into in the pushing mechanism 716 (e.g., in to the tray). From there, the pushing mechanism 716 can be moved forward again to the point shown in FIGS. 11C and 11D where the open end of the mailer $720_2$ would be biased open by the narrowing surfaces 712 of the biasing structure 710. This process can be repeated to dispense some or all of the mailers 720.

Under certain conditions, as the pushing mechanism 716 pushes one of the mailers 720 forward, the mailer may not be properly biased open by the narrowing surfaces 712. For example, under certain conditions, the mailer pushed forward by the pushing mechanism 716 may engage the narrowing surfaces 712 so that the mailer ends up in the orientation of the mailer $404_1$ shown in FIG. 6B. If the mailer $720_1$ is in the orientation of the mailer $404_1$ shown in FIG. 6B when the pushing mechanism 716 is in the position shown in FIGS. 11C and 11D, a user will have a difficult time inserting any object into the mailer $720_1$.

Figure 12C:
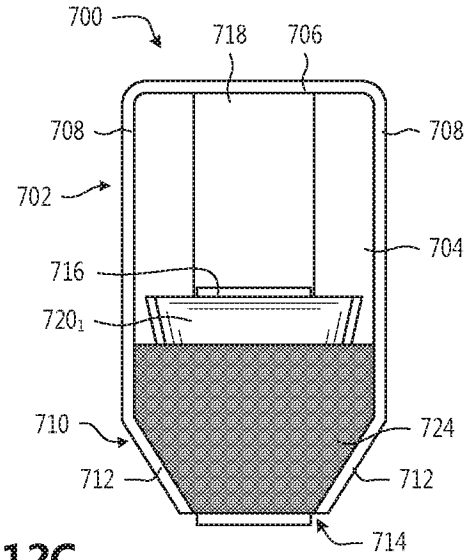
FIGS. 12C and 12D depict top and side views, respectively, of another instance of the dispenser depicted in FIGS. 12A and 12B, in accordance with the embodiments disclosed herein.
Figure 12D:
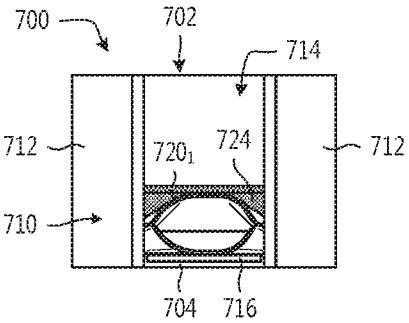
Figure 12A:
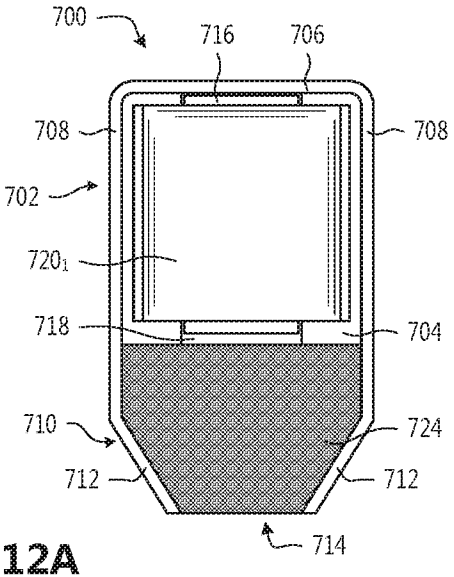
FIGS. 12A and 12B depict top and side views, respectively, of one instance of a variation of the dispenser depicted in FIGS. 11A and 11B, in accordance with the embodiments disclosed herein.
Figure 12B:
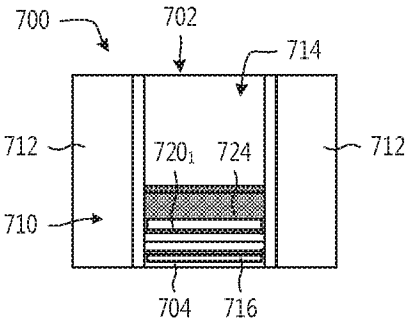

Depicted in FIGS. 12A and 12B are top and side views, respectively, of one instance of another embodiment of the dispenser 700. In particular, the mailer $720_1$ is located in the supply structure 702 in FIGS. 12A and 12B. Depicted in FIGS. 12C and 12D are side and top views, respectively, of another instance of the embodiment of the dispenser 700 shown in FIGS. 12A and 12B. In particular, the mailer $720_1$ has been dispensed from the supply structure 702 and the open end of the mailer $720_1$ is being biased open by the narrowing surfaces 712 of the biasing structure 710 in FIGS. 12C and 12D. In FIGS. 12A to 12D, the dispenser 700 is shown holding only the mailer $720_1$ for convenience in viewing the dispenser 700. However, the embodiment of the dispenser 700 shown in FIGS. 12A to 12D may hold all of the mailers 720 depicted in FIGS. 11A to 11D.

In the embodiment shown in FIGS. 12A to 12D, the dispenser 700 has a guide 724 that is located between the narrowing surfaces 712 of the biasing structure 710. The guide 724 is positioned so that the mailer $720_1$ passes between a portion of the supply structure 702 (e.g., the bottom surface 704) and the guide 724 as the mailer $720_1$ is dispensed from the supply structure 702. In the depicted embodiment, the guide 724 serves as an upper restraint so that, as the closed sides of the mailer $720_1$ are engaged by the narrowing surfaces 712, the closed sides of the mailer $720_1$ cannot be deflected to the extent that the closed sides of the mailer $404_1$ are deflected in FIG. 6B. By limiting the amount of the deflection of the closed sides of the mailer $720_1$, the guide 724 reduces the possibility that the narrowing surfaces 712 will not properly bias open the open end of the mailer $720_1$.

In the depicted embodiment, the rear end of the guide 724 (i.e., the end of the guide 724 that is closer to the rear wall 706) is closer to the bottom surface 704 than the front end of the guide 724 (i.e., the end of the guide that is at the gap 714 between the narrowing surfaces 712). The position of the rear end of the guide 724 may serve as a stop to prevent mailers other than the mailer $720_1$ from being pushed forward when the pushing mechanism 716 pushes the mailer $720_1$ forward. This feature can be useful when the supply structure holds a stack of mailers, such as the mailer 720 shown in FIGS. 11A to 11D. The position of the front end of the guide 724 may accommodate the change in size of the open end of the mailer $720_1$ as the open end of the mailer is biased open by the narrowing surfaces 712.

Figure 13B:
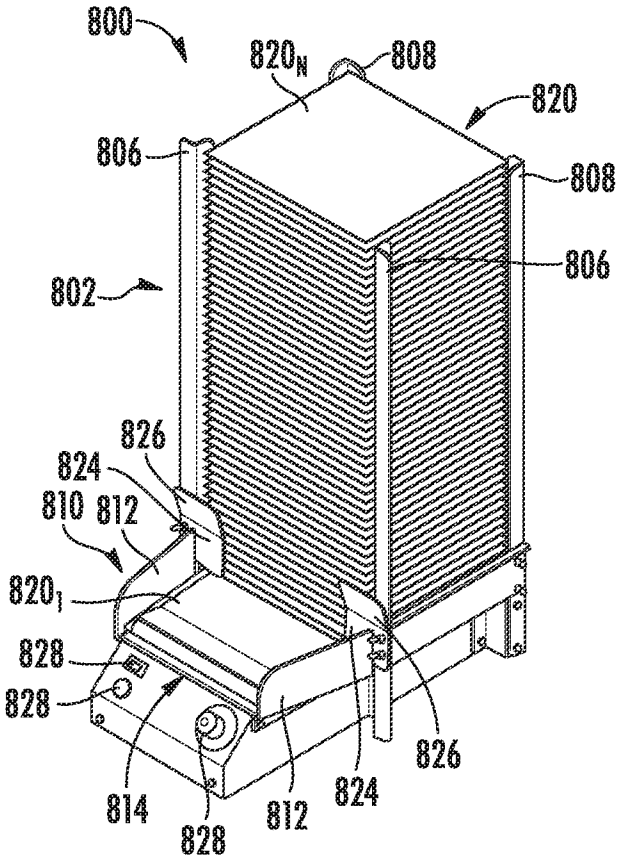
FIGS. 13A and 13B depict perspective views of two different instances of an embodiment of a dispenser, in accordance with the embodiments disclosed herein.
Figure 13A:
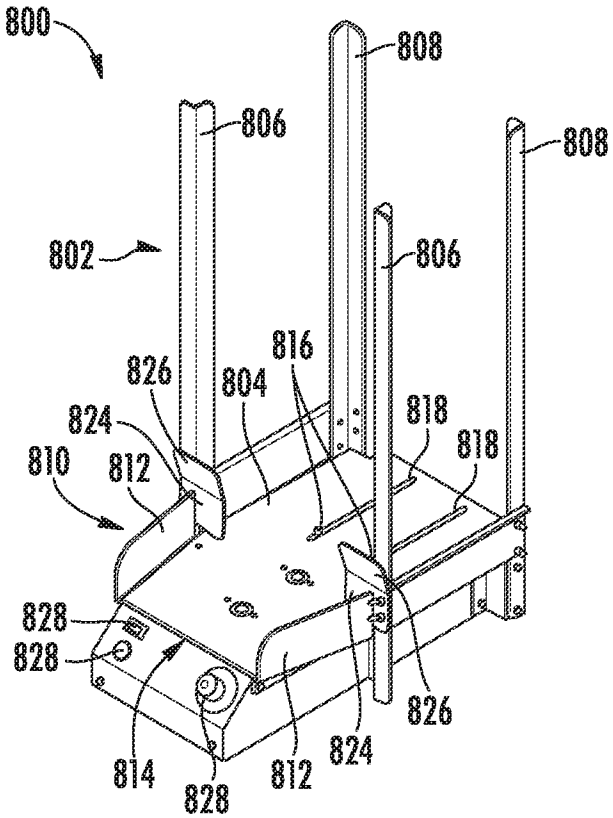

Depicted in FIGS. 13A and 13B are perspective views of two different instances of an embodiment of a dispenser 800. The dispenser 800 includes a supply structure 802. In the depicted embodiment, the supply structure 802 includes a bottom surface 804, front posts 806 extending upward from the bottom surface 804 at the front of the supply structure 802, and rear posts 808 extending upward from the bottom surface 804 at the rear of the supply structure 802. In the depicted embodiment, each of the front and rear posts 806 and 808 is an angle bar having an angle of approximately 90°. The two sides of the angle bar of the front posts 806 are directed toward the rear and away from the center of the dispenser 800. The two sides of the angle bar of the rear posts 808 are directed toward the front and toward the center of the dispenser 800. The dispenser 800 also includes a biasing structure 810. The biasing structure 810 includes narrowing surfaces 812. In the depicted embodiment, each of the narrowing surfaces 812 is coupled to one of the front posts 806. The narrowing surfaces 812 do not meet at the front end of the dispenser 800 so that a gap 814 exists between the narrowing surfaces 812.

As shown in FIG. 13B, the supply structure 802 is configured to hold mailers 820. In the depicted embodiment, the mailers 820 include a mailer $820_1$, which is being dispensed from the supply structure 802, and a number of other mailers, including mailer $820_N$, that are stacked inside of the supply structure 802. When viewing the mailer $820_N$ in the perspective view shown in FIG. 13B, one of the walls of the mailer $820_N$ is visible on top, the closed end of the mailer $820_N$ is on the top right, the closed sides of the mailer $820_N$ are on the top left and bottom right, and the open end of the mailer $820_N$ is on the bottom left. All of the mailers 820 depicted in FIG. 13B are similarly oriented.

The mailers 820 are capable be being dispensed from the supply structure 802 by moving the mailers 820 individually toward the biasing structure 810 and the gap 814 between the narrowing surfaces 812 of the biasing structure 810. In the embodiment shown in FIGS. 13A and 13B, the direction that the mailers 820 are dispensed is substantially perpendicular to the open ends the mailers 820. As will be discussed in greater detail below, the dispenser 800 is configured to mechanically push the mailers 820 individually to dispense the mailers 820 from the supply structure 802. In other embodiments, the dispenser 800 may be configured to permit the mailers 820 to be manually pulled or pushed individually to dispense the mailers 820 from the supply structure 802.

The biasing structure 810 is arranged to engage the mailers 820 as the mailers 820 are dispensed from the supply structure 802. In the depicted embodiment, the biasing structure 810 is located in front of the supply structure 802. In this configuration, the forward movement of the mailers 820 as the mailers 820 are being dispensed from the supply structure 802 results in the mailers 820 engaging the biasing structure 810. In the depicted embodiment, the narrowing surfaces 812 contact the closed sides of the mailers 820 as the mailers 820 are dispensed forward. The narrowing surfaces 812 of the biasing structure 810 are configured to contact the closed sides of the mailers 820 as the mailers 820 are dispensed and the narrowing surfaces 812 are arranged to narrow the open ends of the mailers 820 to cause the open ends to be biased open. In the depicted embodiment, the narrowing surfaces 812 include two planar surfaces arranged with respect to the supply structure 802 so that the sides of the mailers 820 contact the two planar surfaces as the mailers 820 is dispensed from the supply structure 802. The two planar surfaces converge as the two planar surfaces extend in the direction that the mailers 820 are dispensed from the supply structure 802.

As can be seen in FIG. 13A, the dispenser 800 includes a pushing mechanism 816. The pushing mechanism 816 is configured to push the mailers 820 individually from the supply structure 802 in the direction that is substantially perpendicular to the open ends of the mailers 820 until the open ends of the mailer at least reaches the gap 814 between the narrowing surfaces 812 of the biasing structure 810. In the depicted embodiment, the pushing mechanism 816 is in the form of tabs that extend through slots 818 in the bottom surface 804 of the supply structure. The tabs can be moved linearly through the slots 818 (e.g., by a motor or other driving mechanism under the bottom surface 804) to dispense one of the mailers 820 out of the supply structure 802. In the depicted embodiment, the tabs is configured to contact a closed end of one of the mailers 820 so that, as the tabs are pushed forward, the closed end of the one of the mailers 820 is pushed forward.

As can be seen in FIG. 13B, the mailer $\mathbf{820}_1$ has been pushed forward by the pushing mechanism 816 until the open end of the mailer $\mathbf{820}_1$ is biased open by the narrowing surfaces 812 of the biasing structure 810. The open end of the mailer $\mathbf{820}_1$ has been brought forward to the gap 814 between the narrowing surfaces 812. At this location, the narrowing surfaces 812 narrow the open end of the mailer $\mathbf{820}_1$ to cause the open end to be biased open. At the location of the mailer $\mathbf{820}_1$ in FIG. 13B, a user can insert an object into the mailer $\mathbf{820}_1$ through the open end of the mailer $\mathbf{820}_1$. Inserting the object into the mailer $\mathbf{820}_1$ while the open end of the mailer $\mathbf{820}_1$ is biased open may decrease the amount of time that it takes a user to insert the object in the mailer $\mathbf{820}_1$, thereby increasing efficiency of the user's operation. From the position shown in FIG. 13B, the mailer $\mathbf{820}_1$ can be pulled further forward until the mailer $\mathbf{820}_1$ is pulled entirely through the gap 814 between the narrowing surfaces 814. At that point, the open end of the mailer $\mathbf{820}_1$ can be closed.

After the mailer $\mathbf{820}_1$ is removed from the narrowing surfaces 812, the pushing mechanism 816 can be returned to a position with the tabs near the rear ends of the slots 818. At that point, the mailers 820 that remain in the supply structure 802 fall downward so that the next one of the mailers 820 to be dispensed falls in front of the pushing mechanism 816 (e.g., in front of the tabs). From there, the pushing mechanism 816 can be moved forward again to the point shown in FIG. 13B where the open end of the next one of the mailers 820 would be biased open by the narrowing surfaces 812 of the biasing structure 810. This process can be repeated to dispense some or all of the mailers 820. In some embodiments, the pushing mechanism 816 is driven by a driving mechanism (e.g., a motor) beneath the bottom surface 804. In the depicted embodiment, the dispenser includes user input mechanisms 828 to control operation of the dispenser 800. In some examples, the user input mechanisms 828 include one or more of a power button to control whether the dispenser 800 is powered, a dispensing button that can be pushed to cause the pushing mechanism 816 to dispense one of the mailers 820, or an emergency stop button that can be pushed to cease all powered operation of the dispenser 800.

The dispenser 800 has a guide 824 that is located between the narrowing surfaces 812 of the biasing structure 810. The guide 824 is positioned so that the mailer $\mathbf{820}_1$ passes between a portion of the supply structure 802 (e.g., the bottom surface 804) and the guide 824 as the mailer $\mathbf{820}_1$ is dispensed from the supply structure 802. Additional mailers can be placed in the supply structure 802 as needed. In some cases, before the mailer $\mathbf{820}_1$ is dispensed, additional mailers are added to the supply structure 802 on top of the mailer $\mathbf{820}_1$. In this way, the mailers in the supply structure 802 can be continuously supplied without any downtime of the dispenser 800 to reload the supply structure 802. The dispenser includes funneling surfaces 826 located near the front posts 806 that are arranged to aid in guiding the mailers 820 in the supply structure 802 into a position where the mailers 820 can be dispensed when they reach the bottom surface 804.

In the depicted embodiments of dispensers disclosed herein, the supply structures are capable of being filled with mailers by hand. For example, in the dispenser 800, a user can stack the mailers 820 in the supply structure 802 with the openings of the mailer 820 arranged appropriately. However, in many cases, loading mailers by hand can be time-consuming and is subject to human error (e.g., improper orientation of the mailers). In some embodiments, the supply structures may be couplable to a container of mailers that functions as a magazine for the supply structure. For example, the mailers 820 may be provided to a user of the dispenser 800 in a container (e.g., a box). The container may open at a particular location (e.g., one side of the box) and the open container can be coupled to the supply structure 802. In one example, the container that holds the mailers 820 can be coupled to the front posts 806 and the rear posts 808 of the supply structure so that the mailers 820 are able to exit the opening of the container toward the bottom surface 804. As the mailers 820 are dispensed by the dispenser 800, the container will be depleted and removed from the supply structure 820. A new container full of mailers 820 can replace the removed container and continue to supply the mailers 820 to the dispenser 800. In some embodiments, the containers that function as magazines of mailers may hold one hundred or more of the mailers.

Figure 14A:
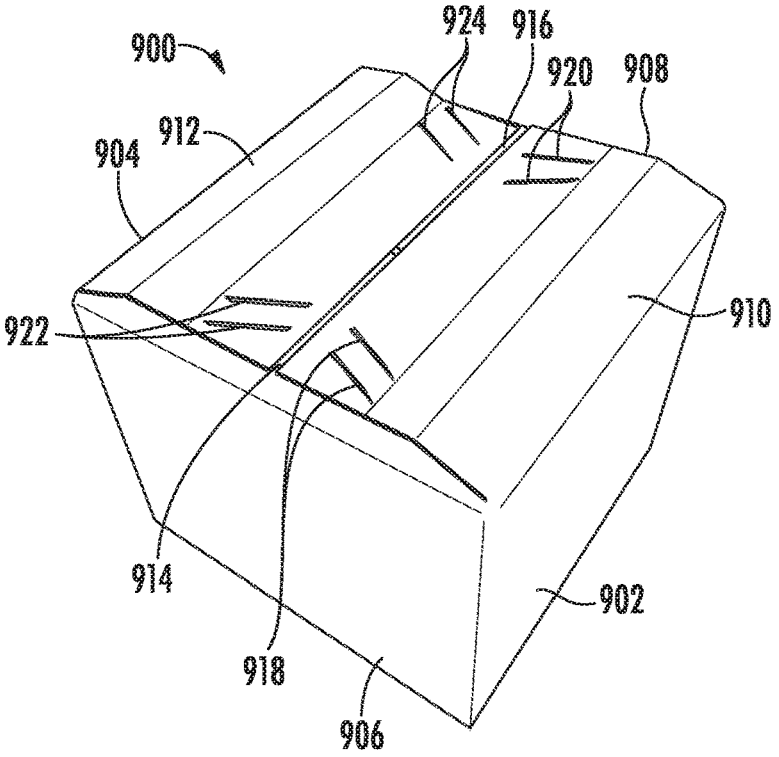
FIGS. 14A and 14B depict perspective views a container in closed and open orientations, respectively, where the container is an embodiment of a dispenser that permits manual dispensing of mailers so that the open ends of the mailers are biased open as the mailers are dispensed, in accordance with the embodiments disclosed herein.
Figure 14B:
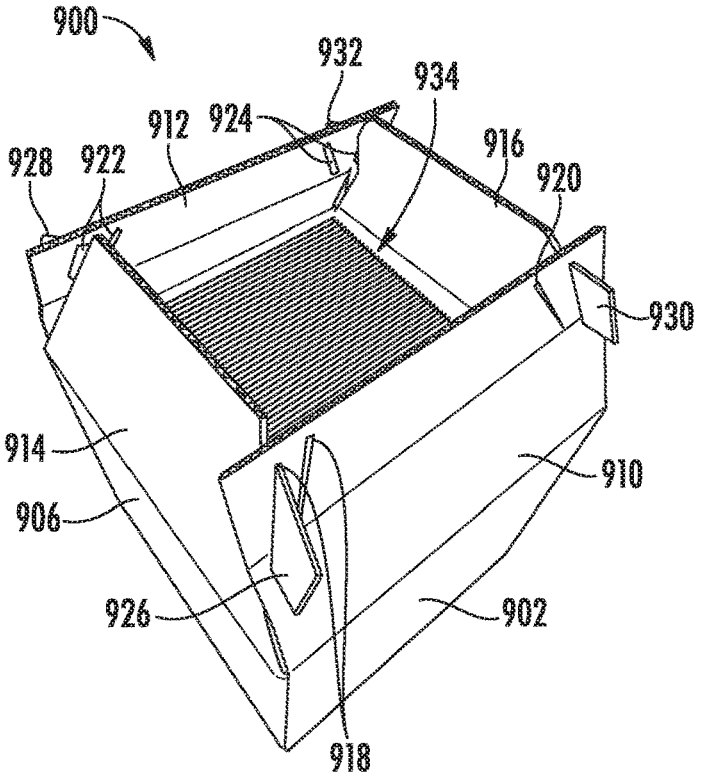

In some embodiments, a container used to ship and/or store mailers can be a dispenser for manually dispensing mailers so that the open ends of the mailers are biased open as the mailers are dispensed. Depicted in FIGS. 14A and 14B are perspective views a container in closed and open orientations, respectively, where the container is an embodiment of a dispenser 900 that permits manual dispensing of mailers so that the open ends of the mailers are biased open as the mailers are dispensed. The dispenser includes a front panel 902, a rear panel 904, a left panel 906, and a right panel 908. Each of the front and rear panels 902 and 904 and the left and right panels 906 and 908 extend upward from a bottom panel (not visible) of the container. The front panel 902, the rear panel 904, the left panel 906, the right panel 908, and the bottom panel form a supply structure. As can be seen in FIG. 14B, the supply structure of the dispenser can hold a number of mailers 934. In the supply structure of the dispenser 900, the mailers 934 are oriented so that the closed ends of the mailers are against the bottom panel and the closed sides of the mailers are near the left and right panels 906 and 908. The open ends of the mailers 934 are oriented upward.

The container also includes a front flap 910 rotatably coupled to the front panel 902, a rear flap 912 rotatably coupled to the rear panel 904, a left flap 914 rotatably coupled to the left panel 906, and a right flap 916 rotatably coupled to the right panel 908. In the depicted embodiment, the set of left and right flaps 914 and 916 form a biasing structure of the dispenser 900. As will be described in greater detail below, the left and right flaps 914 and 916 are narrowing surfaces of the biasing structure.

The set of front and rear flaps 910 and 912 are configured to interconnect with the set of left and right flaps 914 and 916. In the depicted embodiment, the front flap 910 includes left slots 918 and right slots 920 and the rear flap 912 includes left slots 922 and right slots 924. The left flap 914 includes a front tab 926 configured to be selectively interlocked to one of the left slots 918 on the front flap 910 and a rear tab 928 configured to be selectively interlocked to one of the left slots 922 on the rear flap 912. The right flap 916 includes a front tab 930 configured to be selectively interlocked to one of the right slots 920 on the front flap 910 and a rear tab 932 configured to be selectively interlocked to one of the right slots 924 on the rear flap 912. As can be seen in FIG. 14B, the dispenser is configured such that, when the front and rear flaps 910 and 912 are interlocked to the left and right flaps 914 and 916, the left flap 914 is not coplanar with the left panel 906 and the right flap 916 is not coplanar with the right panel 908. In the depicted embodiment, the left and right flaps 914 and 916 converge as they extend away from the left and right panels 906 and 908. In this way, the left and right flaps 914 and 916 can be narrowing surfaces of the biasing structure of the dispenser 900. While the flaps of the dispenser 900 in the depicted embodiment are interconnected with tabs and slots, it will be apparent that any other form of interconnecting features could be used in place of the tabs and slots in the depicted embodiment to interconnect the flaps of the dispenser 900.

Figure 14C:
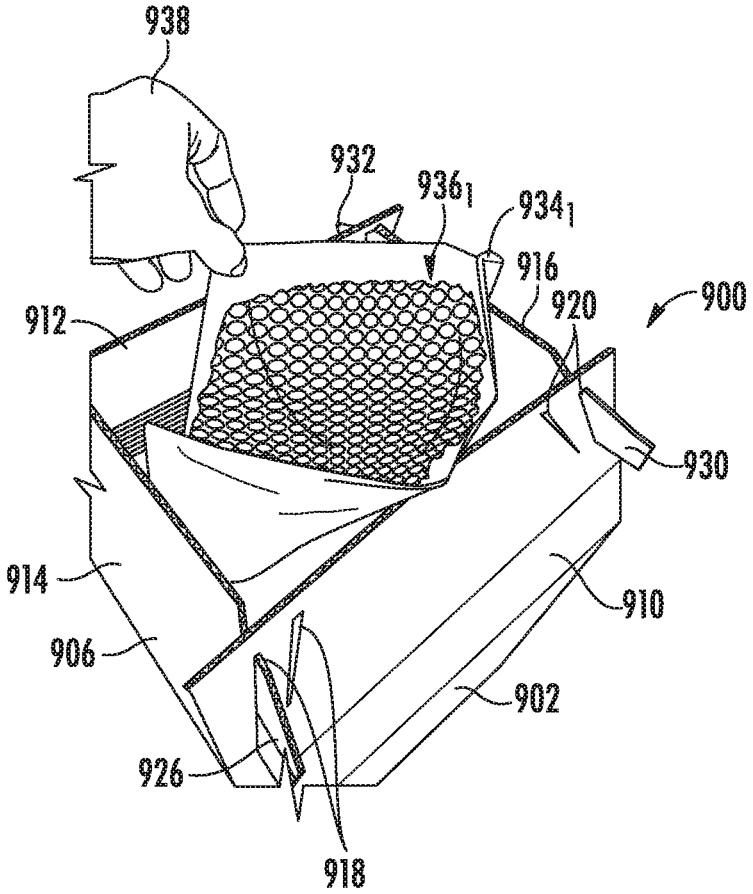
FIG. 14C depicts an embodiment of a user manually dispensing one of the mailers from the dispenser depicted in FIGS. 14A and 14B, in accordance with the embodiments disclosed herein.

FIG. 14C depicts an embodiment of a user 938 manually dispensing one of the mailers 934 from the dispenser 900. In the depicted embodiment, the user 938 is pulling a mailer $\mathbf{934}_1$ from the mailers 934 in the supply structure of the dispenser 900. In the depicted embodiment, the mailer $\mathbf{934}_1$ is dispensed in a direction that is substantially perpendicular to an open end $\mathbf{936}_1$ of the mailer $\mathbf{934}_1$. As the user pulls the mailer $\mathbf{934}_1$ out of the supply structure, the upward movement of the mailer $\mathbf{934}_1$ results in the mailer $\mathbf{934}_1$ engaging the biasing structure of the dispenser. More specifically, the narrowing surfaces formed by the left and right flaps 914 and 916 contact the closed sides of the mailer $\mathbf{934}_1$ as the mailer $\mathbf{934}_1$ is dispensed upward. The narrowing surfaces of the biasing structure are configured to contact the closed sides of the mailer $\mathbf{934}_1$ as the mailer $\mathbf{934}_1$ is dispensed and the narrowing surfaces are arranged to narrow the open end $\mathbf{936}_1$ of the mailer $\mathbf{934}_1$ to cause the open end $\mathbf{936}_1$ to be biased open.

At the location of the mailer $\mathbf{934}_1$ in FIG. 14C, the user 938 can insert an object into the mailer $\mathbf{934}_1$ through the open end $\mathbf{936}_1$ of the mailer $\mathbf{934}_1$. Inserting the object into the mailer $\mathbf{934}_1$ while the open end $\mathbf{936}_1$ of the mailer $\mathbf{934}_1$ is biased open may decrease the amount of time that it takes a user to insert the object in the mailer $\mathbf{934}_1$, thereby increasing efficiency of the user's operation. From the position shown in FIG. 14C, the mailer $\mathbf{934}_1$ can be pulled further forward until the mailer $\mathbf{934}_1$ is pulled entirely out of the container. At that point, the open end $\mathbf{936}_1$ of the mailer $\mathbf{934}_1$ can be closed. The user 938 can then manually dispense another one of the mailer 934 from the dispenser 900 in similar fashion.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A dispenser comprising:

a supply structure configured to hold a plurality of mailers in a stack, wherein a mailer of the plurality of mailers includes a first wall and a second wall, wherein the first and second walls are closed at a first side of the mailer, closed at a second side of the mailer, and closed at a closed end of the mailer, and wherein the first and second walls are not closed at an open end of the mailer, and wherein the mailer is arranged to be dispensed from a bottom of the stack in the supply structure; and a biasing structure arranged to engage the mailer as the mailer is dispensed from the bottom of the stack in the supply structure;

wherein the biasing structure has narrowing surfaces configured to contact the sides of the mailer as the mailer is dispensed from the bottom of the stack, wherein the narrowing surfaces of the biasing structure are arranged to narrow the open end of the mailer thereby causing the open end to be biased open;

wherein the dispenser is arranged to dispense the mailer from the supply structure in a direction that is substantially perpendicular to the open end of the mailer;

wherein the narrowing surfaces are arranged with respect to the supply structure so that the sides of the mailer contact the narrowing surfaces as the mailer is dispensed from the supply structure in the direction that is substantially perpendicular to the open end of the mailer;

wherein the dispenser further comprises a pusher configured to push the mailer from the supply structure in the direction that is substantially perpendicular to the open end of the mailer until the open end of the mailer at least reaches an opening between the narrowing surfaces; and wherein the pusher includes at least one tab extending through at least one slot in a bottom of the supply structure.

2. The dispenser of claim 1, further comprising:

a guide positioned so that the mailer passes between a portion of the supply structure and the guide as the mailer is dispensed from the supply structure in the direction that is substantially perpendicular to the open end of the mailer.

3. The dispenser of claim 2, wherein the portion of the supply structure is a bottom of the supply structure and wherein the guide is configured so that the mailer passes beneath the guide as the mailer is dispensed from the supply structure in the direction that is substantially perpendicular to the open end of the mailer.

* * * * *